US009348291B2

(12) United States Patent
Yamamoto

(10) Patent No.: US 9,348,291 B2
(45) Date of Patent: May 24, 2016

(54) IMAGE FORMING APPARATUS AND IMAGE FORMING SYSTEM WITH CORRECTION MECHANISM

(71) Applicant: Kazuya Yamamoto, Kanagawa (JP)

(72) Inventor: Kazuya Yamamoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/880,051

(22) Filed: Oct. 9, 2015

(65) Prior Publication Data

US 2016/0103410 A1 Apr. 14, 2016

(30) Foreign Application Priority Data

Oct. 10, 2014 (JP) ..... 2014-209201
Jun. 5, 2015 (JP) ..... 2015-115097

(51) Int. Cl.

| | |
|---|---|
| ***G03G 15/00*** | (2006.01) |
| ***G03G 21/00*** | (2006.01) |
| ***B65H 85/00*** | (2006.01) |
| ***B65H 9/00*** | (2006.01) |

(52) U.S. Cl.
CPC ..... *G03G 15/6564* (2013.01)

(58) Field of Classification Search
CPC ... G03G 15/00; G03G 15/6564; G03G 15/23; G03G 21/00; G03G 21/14; B65H 85/00; B65H 9/00; B65H 9/10
USPC ..... 399/361, 364, 381, 401
See application file for complete search history.

(56) References Cited

U.S. PATENT DOCUMENTS 6,137,989 A * 10/2000 Quesnel ..... B65H 9/103 347/248
6,813,451 B2 * 11/2004 Wibbels ..... G03G 15/234 399/394
7,770,879 B2 8/2010 Kazama et al.
8,205,878 B2 6/2012 Masuda
8,571,460 B2 * 10/2013 deJong ..... B65H 5/34 271/265.02
2004/0046313 A1 * 3/2004 Herrmann ..... B65H 9/002 271/226
2004/0215411 A1 * 10/2004 Howe ..... B65H 9/106 702/85
2004/0251611 A1 * 12/2004 Rapkin ..... B41J 3/60 271/226
2006/0285903 A1 * 12/2006 Yamane ..... B65H 9/002 399/394
2007/0242997 A1 * 10/2007 Takahashi ..... B41J 3/60 399/395

(Continued)

FOREIGN PATENT DOCUMENTS

JP 10035948 A * 2/1998 ..... G03G 15/00
JP 10310288 A * 11/1998 ..... B65H 9/00

(Continued)

*Primary Examiner* — Nguyen Ha
(74) *Attorney, Agent, or Firm* — Oblon, McClelland, Maier & Neustadt, L.L.P

(57) ABSTRACT

An image forming apparatus and an image forming system, the image forming apparatus including a memory to store first side position and second side position detected by a side end detector, a correction mechanism to movably support at least a registration roller of a first sheet conveyor and a second sheet conveyor in a direction perpendicular to a sheet conveying direction, and a controller to calculate a deviation between the first side position and the second side position, and to set the deviation as a correction amount of the correction mechanism.

15 Claims, 13 Drawing Sheets

(56) References Cited

U.S. PATENT DOCUMENTS

2007/0264066 A1* 11/2007 Peng ..... G03G 15/5062 399/395
2010/0308532 A1* 12/2010 deJong ..... B65H 5/34 271/227
2011/0049794 A1* 3/2011 Kinoshita ..... B65H 9/002 271/227
2011/0052292 A1* 3/2011 Prabhat ..... G03G 15/6561 399/395
2011/0064499 A1* 3/2011 Johnston ..... B65H 7/14 399/388
2012/0269563 A1* 10/2012 Ui ..... B65H 7/10 399/367
2015/0132016 A1* 5/2015 Aoki ..... G03G 15/6567 399/16
2015/0239687 A1 8/2015 Shinkawa et al.
2015/0249764 A1* 9/2015 Nakatani ..... G03G 15/0131 358/1.5
2015/0378297 A1* 12/2015 Nakura ..... G03G 15/6558 399/395

FOREIGN PATENT DOCUMENTS

JP 2005194016 A * 7/2005 ..... B65H 85/00
JP 2005208406 A * 8/2005 ..... G03G 15/00
JP 2005263463 A * 9/2005 ..... G03G 21/00
JP 2006027859 A * 2/2006 ..... B65H 9/00
JP 2006206195 A * 8/2006 ..... B65H 9/00
JP 2011185976 A * 9/2011 ..... B65H 85/00
JP 2013018653 A * 1/2013 ..... G03G 21/14

* cited by examiner

IMAGE FORMING APPARATUS AND IMAGE FORMING SYSTEM WITH CORRECTION MECHANISM

CROSS-REFERENCE TO RELATED APPLICATIONS

This patent application is based on and claims priority pursuant to 35 U.S.C. §119(a) to Japanese Patent Application No. 2014-209201, filed on Oct. 10, 2014, and to Japanese Patent Application No. 2015-115097, filed on Jun. 5, 2015 in the Japan Patent Office, the entire disclosure of each of which is hereby incorporated by reference herein.

BACKGROUND

1. Technical Field

The present disclosure relates to an image forming apparatus and an image forming system which includes a duplex printing mode. The image forming apparatus and the image forming system include, for example, a copier, a printer, a facsimile machine, or a multifunction peripheral having at least two of copying, printing, facsimile transmission, plotting, and scanning capabilities.

2. Description of the Related Art

Image forming apparatus such as printers, digital copiers, facsimiles and multifunctional peripherals (capable of serving at least two of the following functions: printer, copier and facsimile), generally include a sheet feeding device, a sheet conveyance device and an image forming unit. The sheet feeding device feeds a sheet to a sheet conveyance path. The sheet conveyance device conveys the sheet along the sheet conveyance path. The image forming unit outputs an image on the sheet. The sheet conveyance path of the sheet conveyance device includes a plurality of conveyance rollers thereon. The conveyance rollers are rotationally driven by drive sources such as motors to convey the transfer sheet.

Such image forming apparatuses can be provided with a registration device which adjusts the sheet position relative to an image position in a direction perpendicular to a sheet conveying direction. The sheet position in the direction needs to be corrected at an upstream side from a position in which the image is output on the sheet so that the image can be formed on an accurate position of the sheet in the direction. This correction of position in the direction is hereinafter referred to as a side registration correcting operation.

It is an object of the present disclosure to accurately correct relative positions of images formed on both faces of a sheet when the image forming apparatus includes a duplex printing mode.

SUMMARY

An image forming apparatus that includes a sheet feeder, including a roller, to feed a sheet to a sheet conveyance passage, an image former, including a transfer belt, to form an image on the sheet, a first sheet conveyor, including a registration roller, at an upstream side of an image forming position in which the image former forms the image on the sheet, to convey the sheet along a sheet conveying direction, a sheet reverser, including a guiding roller, to reverse the sheet on which the image is formed on a first face, a second sheet conveyor, including a conveying roller, to convey the sheet, which is reversed by the sheet reverser, to the first sheet conveyor, a side end detector disposed near the first sheet conveyor to detect a first side position and a second side position, a memory to store the first side position and the second side position detected by the side end detector, a correction mechanism, including a movable plate, to movably support at least the registration roller of the first sheet conveyor and the second sheet conveyor in a direction perpendicular to the sheet conveying direction, and a controller to calculate a deviation between the first side position and the second side position, and to set the deviation as a correction amount of the correction mechanism. The first side position is a side end position of the first face of the sheet and the second side position is a side end position of the second face of the sheet, and, in a side registration correcting operation, the controller controls movement of the correction mechanism by the correction amount.

BRIEF DESCRIPTION OF THE SEVERAL VIEWS OF THE DRAWINGS

A more complete appreciation of the disclosure and many of the intended advantages thereof will be readily obtained as the same becomes better understood by reference to the following detailed description when considered in connection with the accompanying drawings.

DETAILED DESCRIPTION

Figure 1:
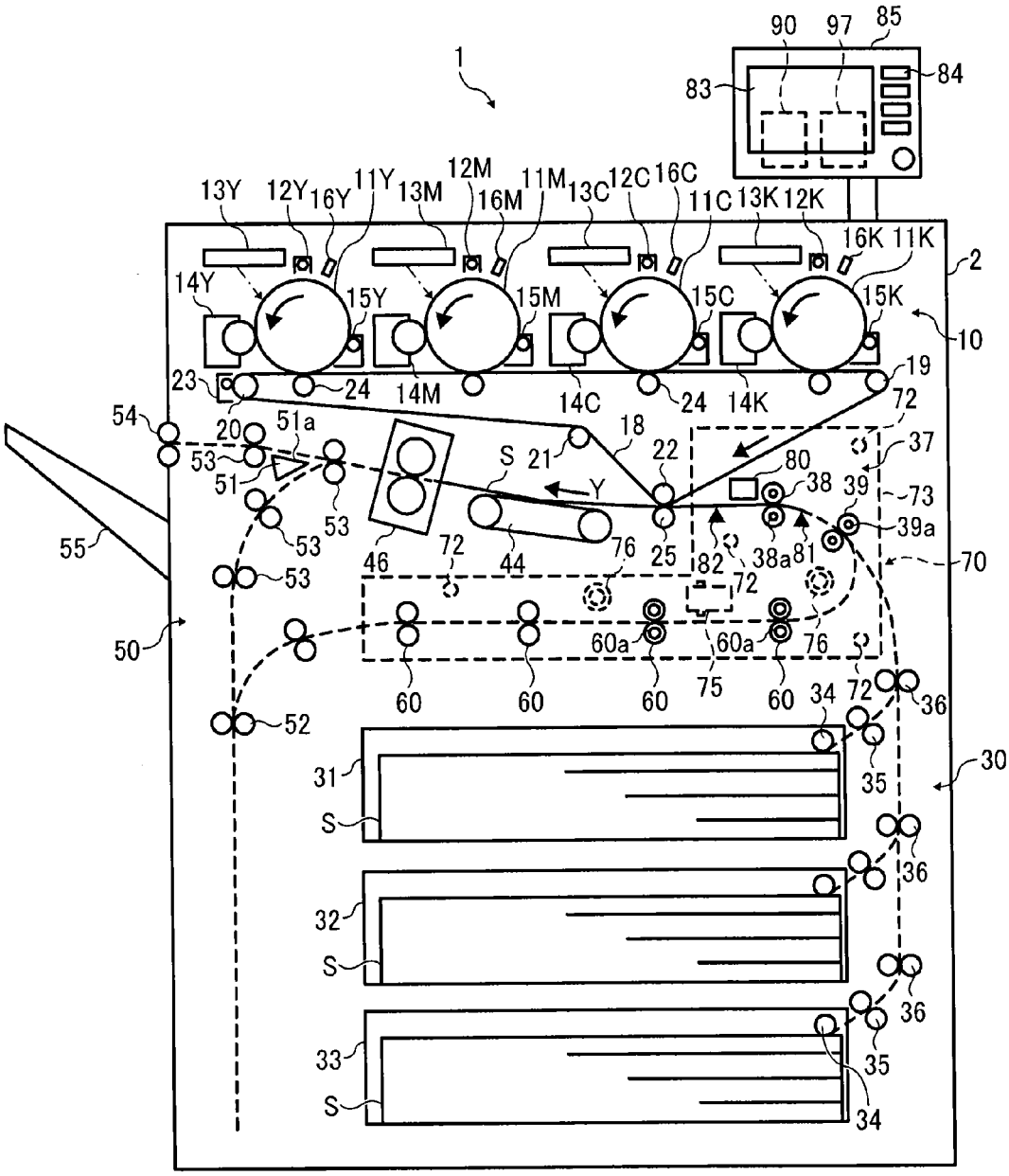
FIG. 1 is a schematic cross-sectional view of an image forming apparatus according to a first embodiment in one state of an operation.

Various embodiments will be described below with reference to the accompanying drawings. In the descriptions of the embodiments, the same components or components with the same functions are denoted by the same reference symbols, and the same explanation will not be repeated in subsequent embodiments. The descriptions below are mere examples and do not limit the scope of the appended claims. Further, a person skilled in the art may easily conceive other embodiments by making modifications or changes within the scope of the appended claims; however, such modifications and changes obviously fall within the scope of the appended claims. In the drawings, Y, M, C, and K are symbols appended to components corresponding to yellow, magenta, cyan, and black, respectively, and will be omitted appropriately.

Referring now to the drawings, a four tandem type printer including an intermediate transfer system serving as an image forming apparatus according to an embodiment is described below.

First Embodiment

Figure 2:
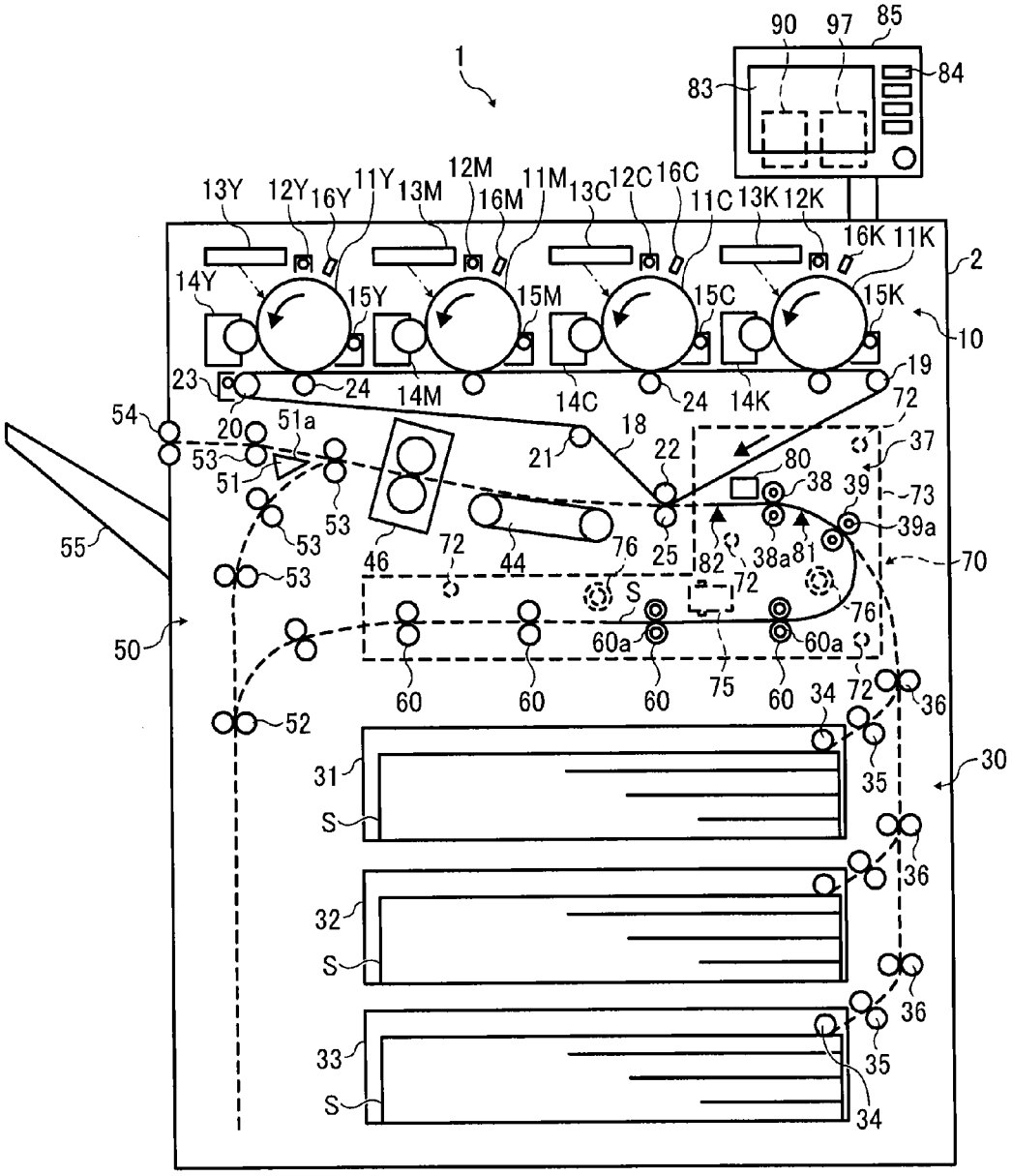
FIG. 2 is a schematic cross-sectional view of the image forming apparatus illustrated in FIG. 1 in another state of the operation.
Figure 3:
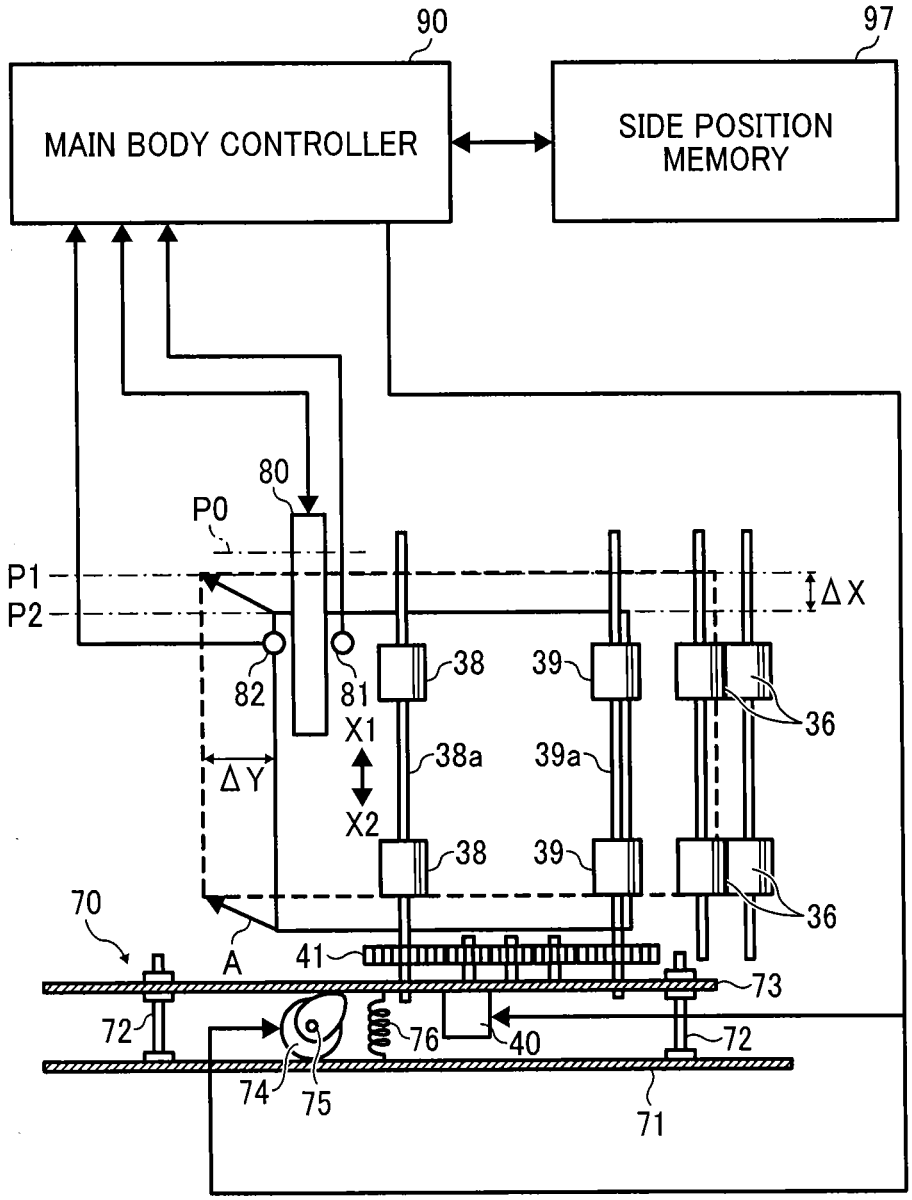
FIG. 3 is a schematic plan view of a side registration correcting mechanism of the image forming apparatus illustrated in FIG. 1 which includes a block diagram.

Referring to FIG. 1 through FIG. 3, the printer 1 serving as an image forming apparatus according to a first embodiment includes, inside a casing 2, an image forming part (image former) 10, a sheet feeding part (sheet feeder) 30, a first sheet conveyance part (first sheet conveyor) 37, a fixing device 46, a sheet reversing part (sheet reverser) 50, and a second sheet conveyance part (second sheet conveyor) 60.

Further, the printer 1 includes a plurality of characteristic parts, which include a side registration correcting mechanism 70 serving as a correction mechanism, a side position detector 80 serving as a side end detector, and a main body controller 90 serving as a controller. The image forming part 10 includes four colors of image forming stations. These configurations are explained more specifically below.

Referring to FIG. 1, the image forming part 10 includes photoconductors 11Y, 11M, 11C, 11K serving as image bearers corresponding to four colors which are disposed along an upper surface of an intermediate transfer belt 18. Further, the image forming part 10 includes toner image forming parts 12 (12Y, 12M, 12C, 12K), 13 (13Y, 13M, 13C, 13K), 14 (14Y, 14M, 14C, 14K), 15 (15Y, 15M, 15C, 15K), 16 (16Y, 16M, 16C, 16K) which are forming visible images for each color, an intermediate transfer belt 18 serving as an intermediate transfer medium which is transferred the visible images from each of the photoconductors 11Y, 11M, 11C, 11K, and a secondary transfer roller 25 which transfers a layered image, that is layered four colors of visible images, on a sheet S serving as a recording medium.

The toner image forming parts 12, 13, 14, 15, 16 are arranged in a rotational direction of the photoconductor 11 in this order. And, the toner image forming parts 12, 13, 14, 15, 16 are, for example explained in the Yellow station representative of other colors, a charging device 12 serving as a charger which takes a charge to a surface of the photoconductor 11, a laser scanning device 13 serving as an exposing device, a developing device 14, a cleaning device 15 to clean a remaining toner on the surface of the photoconductor 11 after transferring, and a quenching lamp 16 serving as a neutralizer which neutralizes a charged surface of the photoconductor 11. In the other color stations includes the same configuration as the Yellow station. And each of primary transfer rollers 24 pushes the intermediate transfer belt 18 toward each of the photoconductors 11 corresponding to each of primary transfer rollers 24.

The intermediate transfer belt 18 is seamless and is wound around a first roller 19, a second roller 20, a third roller 21, and a fourth roller 22 serving as a plurality of support members and moves the rollers 19-22 around. A cleaning device 23 of the intermediate transfer belt 18 is disposed at the position facing the second roller 20. The secondary transfer roller 25, which is driven, is disposed below the fourth roller 22 and pushes the sheet S toward the intermediate transfer belt 18.

A belt conveyor 44 is disposed at a downstream side of the secondary transfer roller 25 in a sheet conveying direction. Further a fixing device 46 fixes the visible toner image on the sheet S and is disposed at the downstream side of the belt conveyor 44 in the sheet conveying direction.

Accordingly, each color of the four toner images is formed on each of the surfaces of the photoconductors 11Y, 11M, 11C, 11K, and the four toner images are transferred on an outer surface of the intermediate transfer belt 18 by a primary transferring. As a result of the primary transferring, the four toner images are layered on the outer surface of the intermediate transfer belt 18. The layered image including four colors of toner images is transferred on the sheet S by a secondary transferring. After that the layered image on the sheet S is fixed by heating and pressing of the fixing device 46. A printing operation of the image forming apparatus is performed in this sequence.

The sheet feeding part 30 includes first, second, and third sheet hoppers 31, 32, 33 which are vertically disposed at a bottom side of the casing 2, and includes a plurality of roller pairs 36 serving as a vertical sheet conveyor which takes over the sheet S from one of the sheet hoppers, upwardly conveys the sheet S, and transfers the sheet S to a first sheet conveyance part 37. Each of the sheet hoppers includes a pick-up roller 34 which picks up a single sheet from the sheet hopper. The sheet S is not limited to plain paper, and may include thick paper, a postcard, an envelope, thin paper, coated paper, art paper, tracing paper, or the like. The sheet S may be an OHP (Over-Head Projector) sheet, an OHP films, or the like. In other words, the sheet S may be any type of recording medium capable of carrying an image thereon.

A user who operates the printer 1 selects one of sheet hoppers 31, 32, 33 which accommodates a preferred sheet for the user via the main body controller 90 or an input terminal such as a personal computer which is connected to a network and which is constructed in a system. Thereby, a sheet S which is accommodated in the selected one of sheet hoppers 31, 32, 33 is conveyed upwardly to the first sheet conveyance part 37 which is disposed on a downstream side in the sheet conveying direction.

An image forming position where the layered image on the intermediate transfer belt 18 is transferred to the sheet S is, in other words, a secondary transferring position where the secondary transfer roller 25 and the intermediate transfer belt 18 form a contact nip. The first sheet conveyance part 37 is disposed on an upstream side relative to the secondary transferring position in the sheet conveying direction and is on the virtual surface which extends horizontally from the contact nip. The first sheet conveyance part 37 includes a registration roller pair 38 and a relay roller pair 39 which is disposed on an upstream side relative to the registration roller pair 38 in the sheet conveying direction.

The registration roller pair 38 and the relay roller pair 39 are configured to rotate intermittently, and to sequentially receive the sheet S which is sequentially conveyed from the plurality of roller pairs 36, and to convey along the sheet conveying direction toward the secondary transferring position.

A sheet reversing part 50 includes a plurality of guiding roller pairs 53, a bifurcating claw 51, and a switch back roller pair 52. The plurality of guiding roller pairs 53 is disposed downstream side relative to the fixing device 46 in the sheet conveying direction. A part of the plurality of guiding roller pairs 53 is arranged almost horizontally and the other part of the plurality of guiding roller pairs 53 is arranged almost vertically downward the fixing device 46. The bifurcating claw 51 is disposed at a position just downstream of a most upstream one of the plurality of guiding roller pairs 53 in the sheet conveying direction. The switch back roller pair 52 is disposed downwardly relative to a most downward one of the plurality of guiding roller pairs 53.

The switch back roller pair 52 is configured to intermittently rotate, corresponding to a conveyance of the sheet S, in one rotational direction and in another rotational direction. The plurality of guiding roller pairs 53 is configured to rotate intermittently corresponding to a conveyance of the sheet S.

The bifurcating claw 51 is formed in a wedge-shape by an upper inclined surface and a lower inclined surface thereof. An end portion 51*a* which is a tip portion of the wedge-shape faces upstream side in the sheet conveying direction. The bifurcating claw 51 is configured to move the end portion 51*a* up and down by an actuator. In the simplex printing mode, the end portion 51*a* of the bifurcating claw 51 is moved down by the actuator. Then, the end portion 51*a* is positioned below (or lower) relative to a sheet conveyance surface (virtual surface) of the most upstream pair of the plurality of guiding roller pairs 53 in the sheet conveying direction.

Accordingly, the sheet S is conveyed over the upper inclined surface of the bifurcating claw 51 and toward the plurality of guiding roller pairs 53 and an ejecting roller pair 54 at the downstream in the sheet conveying direction. The sheet S is ejected on a stack tray 55 by the ejecting roller pair 54.

Meanwhile, in the duplex printing mode, the end portion 51*a* is positioned higher relative to the sheet conveyance surface (virtual surface) of the most upstream pair of the plurality of guiding roller pairs 53 in the sheet conveying direction until printing a first face of a duplex printing is finished. The end portion 51*a* is positioned below (or lower) relative to the sheet conveyance surface (virtual surface) of the most upstream pair of the plurality of guiding roller pairs 53 in the sheet conveying direction until printing a second face of a duplex printing is finished.

Accordingly, after printing a first face of a duplex printing, the sheet S is conveyed under the lower inclined surface of the bifurcating claw 51 and toward the switch back roller pair 52. Before the sheet S passes through the switch back roller pair 52, the switch back roller pair 52 stops to rotate, and then, the switch back roller pair 52 starts to rotate in the counter direction. Consequently, the sheet S which is upside down is conveyed horizontally toward a second sheet conveyance part 60. Further, after printing a second face of a duplex printing, in the same manner as the simplex printing mode, the end portion 51*a* is positioned below (or lower) relative to the sheet conveyance surface (virtual surface) of the most upstream pair of the plurality of guiding roller pairs 53 in the sheet conveying direction.

The second sheet conveyance part 60 includes a plurality of conveying roller pairs (hereinafter, referred to as "a conveying roller pair 60") which is arranged along a sheet conveyance surface parallel to a sheet conveyance surface formed at the contact nip of secondary transferring, which is disposed lower than the contact nip, and which is configured to rotate intermittently.

The plurality of conveying roller pairs 60 receives the sheet S which is reversed from the switch back roller pair 52 and conveys so as to pass the sheet S to the first sheet conveyance part 37 which includes the registration roller pair 38 and the relay roller pair 39.

Consequently, in the simplex printing mode, the sheet S in the selected one of sheet hoppers 31, 32, 33 is picked up by the pick-up roller 34 and the feed roller pair 35 and is conveyed upwardly by the plurality of roller pairs 36.

Subsequently, the sheet S is conveyed by the relay roller pair 39 and the registration roller pair 38 toward the contact nip and is pressed by the secondary transfer roller 25 at the contact nip with the intermediate transfer belt 18 and the layered image including four colors of toner images is transferred on the intermediate transfer belt 18 by the secondary transferring. After that, the layered image on the sheet S is fixed by the fixing device 46 and the sheet S is ejected on the stack tray 55.

Meanwhile, in the duplex printing mode, in the same manner as the simplex printing mode, at first, the sheet S is printed on the first face (see FIG. 1), after that, the sheet S is reversed by the sheet reversing part 50 and is subsequently conveyed by the plurality of conveying roller pairs 60. Next, the sheet S is subsequently conveyed by the first sheet conveyance part 37 which includes the relay roller pair 39 and the registration roller pair 38 (see FIG. 2).

After that, similar to the simplex printing mode described above, the second face of the duplex printing is transferred (the layered image including four colors of toner images) on the intermediate transfer belt 18 by the secondary transferring. After that, the layered image on the second face is fixed by the fixing device 46 and the sheet S is ejected on the stack tray 55.

Figure 4:
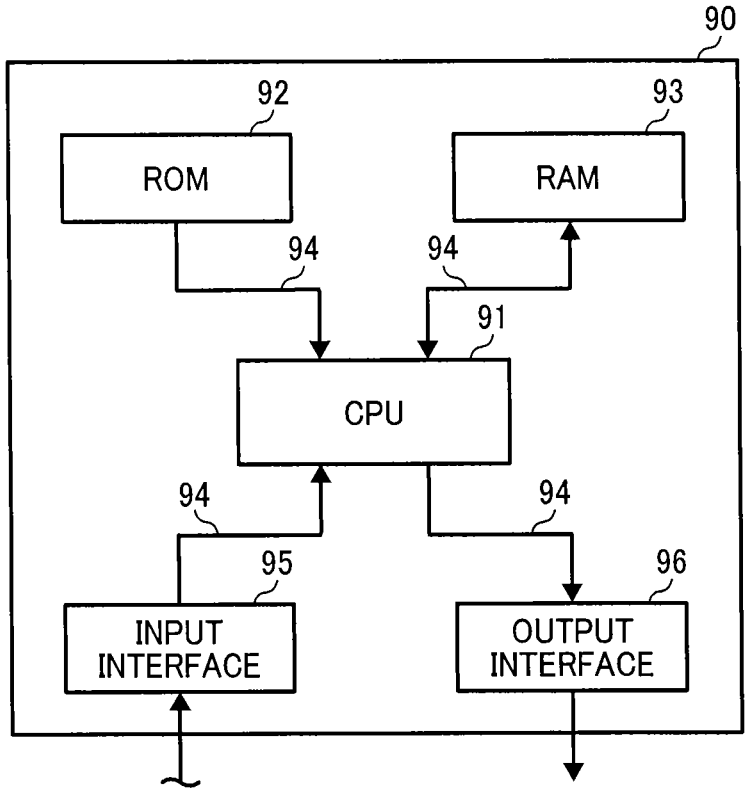
FIG. 4 is a block diagram of a main body controller of the image forming apparatus in the first embodiment.
Figure 5:
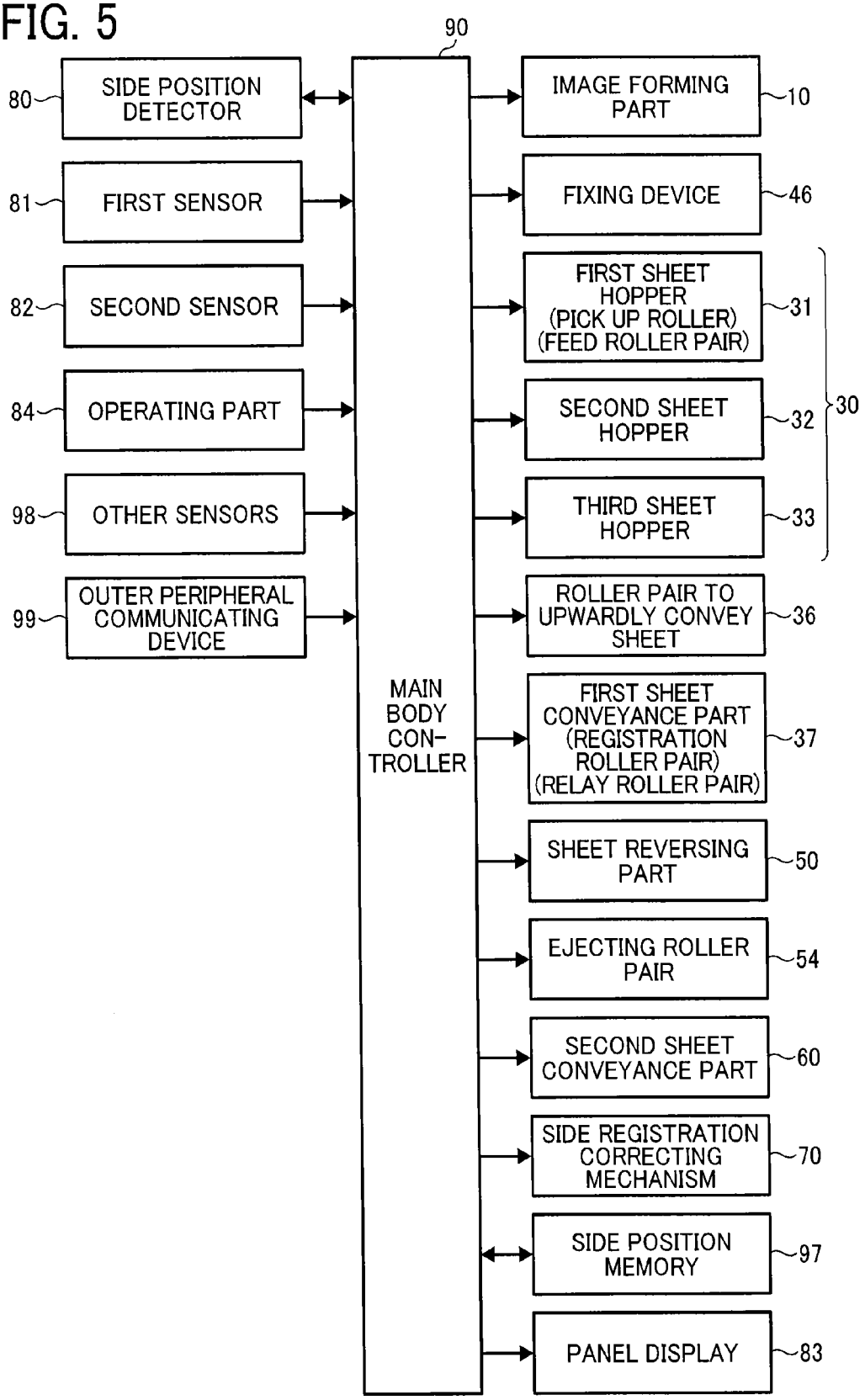
FIG. 5 is a block diagram of an overall image forming apparatus in the first embodiment.

FIG. 4 is a block diagram of the main body controller 90 of the printer 1, and FIG. 5 is a block diagram of the overall printer 1. The main body controller 90 serves as a controller in the present disclosure.

As illustrated in FIG. 4, the main body controller 90 includes a CPU 91 (Central Processing Unit), a ROM 92 (Read Only Memory) which stores fixed data, a RAM 93 (Random Access Memory) which stores temporary data, a INPUT interface 95, and a OUTPUT interface 96.

The ROM 92 stores programs for which the CPU 91 performs operations. The RAM 93 functions as a work area which is used by the CPU 91 when the CPU 91 performs operations. The main body controller 90 can include communication capabilities. The main body controller 90 is configured to entirely control the operations in the printer 1.

For example, the ROM 92, serving as a memory, stores a program that is used for controlling the printer 1 including the side registration correcting operation in the first embodiment. The CPU 91 is configured to perform an arithmetic processing based on the program which is stored in the ROM 92. The RAM 93 is configured to temporary store a result of the arithmetic processing of the CPU 91, data which is input from an operating part 84 (described later), and etc.

The CPU 91, the ROM 92, and the RAM 93 are connected with each other via a bus 94 and are connected with the INPUT interface 95 and the OUTPUT interface 96.

As illustrated in FIG. 4 and FIG. 5, the INPUT interface 95 in the main body controller 90 is connected with a side position detector 80 (side end detector), a first sensor 81, a second sensor 82, the operating part 84, other sensors 98, and an outer peripheral communicating device 99. The INPUT interface 95 receives detection signals and instruction signals from the devices with which the INPUT interface 95 is connected.

The OUTPUT interface 96 in the main body controller 90 is connected with each of the following object parts: the image forming part 10, the fixing device 46, the sheet feeding part which includes first, second, and third feeding hoppers 31, 32, 33, the roller pair 36, the first sheet conveyance part 37, the sheet reversing part 50, the ejecting roller pair 54, the second sheet conveyance part 60, the side registration correcting mechanism 70, and a side position memory 97 (side end memory). Further, the OUTPUT interface 96 is connected with a panel display 83.

The side position memory 97 is also connected with the INPUT interface 95. The main body controller 90 is configured to perform an arithmetic processing based on the detection signals which are inputted via the INPUT interface 95, and is configured to perform various operations, which corresponds to operations of each of the object parts, via the OUTPUT interface 96.

The side position memory 97 includes a nonvolatile memory and is configured to store position data which includes a position P1 of side end of sheet in a first face and a position P2 of side end of sheet in a second face. The side position memory 97 can be included in the main body controller 90.

In a configuration in which a length along the sheet conveyance passage between the feed roller pair 35 and the secondary transfer roller 25 (as a printing position) is longer than a length of a maximum sheet used in the image forming apparatus, and which has a plurality of conveying rollers disposed along the sheet conveyance passage, all of the plurality of conveying rollers would have to be shift rollers or the plurality of conveying rollers would have to partly include separation rollers to be able to move. However, it is not possible to move the sheet in a direction perpendicular to the sheet conveying direction because all of the rollers are not shift rollers or separation rollers.

For this reason, the length along the sheet conveyance passage between the feed roller pair 35 and the secondary transfer roller 25 should be longer. Consequently, the width of the machine becomes larger corresponding to the length of the sheet conveyance passage. Recently, the maximum size of the sheet used in the image forming apparatus is often bigger, such as SRA3 or 13"×19".

Further, the width of the machine usually depends on a size of the image forming part 10 (including transfer device and fixing device) and on a layout of the image forming part 10, because the size and the layout of the image forming part 10 affect the quality of the output image, the durability, and the printing speed. For this reason, it is difficult to shorten the sheet conveyance passage, without also changing the image forming part 10.

For these reasons, it is difficult to mount the side registration correcting mechanism 70 into the image forming apparatus, when the width of the machine is small.

Recently, high accuracy of the image position in the field of the light-production printing is required. The term of "high accuracy of the image position" includes two meanings, one is that an absolute position of the image on each face of each sheet, the other is that a relative position of the images on both faces of each sheet.

In the first embodiment, as illustrated in FIG. 1, an input display device 85 is disposed above the casing 2 of printer 1. The input display device 85 includes a panel display 83, an operating part 84, the main body controller 90, and the side position memory 97.

In the first embodiment, there is a characteristic to perform a side registration correction in the duplex printing mode. The side registration correction in the first embodiment is described later by referring to FIG. 1 through FIG. 5.

The meaning of "a side registration correction" is to correct the relative position of the images on both faces of each sheet in the duplex printing mode. In other words, the meaning of "the side registration correction" is to reduce a position difference (deviation) between an image formed on the first face of the sheet and an image formed on the second face of the sheet. In a case that the position difference of the relative positions of images is lower, a position accuracy (two side accuracy) of the relative positions of images is higher. The side registration correction is to be performed only in the duplex printing mode, and not to be performed in the simplex printing mode.

FIG. 3 is a schematic plan view of the side registration correcting mechanism 70 of the printer 1, which includes the main body controller 90, and performs an operation of the side registration correction in the duplex printing mode.

As illustrated in FIG. 3, the side registration correction of the printer 1 in the first embodiment is configured to work by a cooperation of a side registration correcting mechanism 70, the side position detector 80 (side end detector), the first sensor 81, the second sensor 82, and the main body controller 90.

The side registration correcting mechanism 70 includes a side plate 71, a plurality of guide 72, and a movable plate 73 (plate). The side plate 71 is disposed on a side of a sheet conveyance passage where printing is performed, and inside of the casing 2. The side plate 71 is formed in a vertical face shape along the sheet conveyance passage, and fixed on the side of the sheet conveyance passage. The plurality of guide 72 are configured to guide the movable plate 73 such that the movable plate 73 is parallel to the side plate 71 between the side plate 71 and the sheet conveyance passage. The plurality of guides 72 are fixed to the side plate 71 at one end thereof, and the other end of the side plate 71 protrudes in a direction perpendicular to the sheet conveying direction.

Further, the side registration correcting mechanism 70 includes a rotary actuator 74, a cam 75 (eccentric cam), and a plurality of springs 76. The rotary actuator 74 is fixed to the side plate 71 between the side plate 71 and the movable plate 73. The cam 75 is fixed to an output shaft of the rotary actuator 74. The plurality of springs 76 is fixed to the side plate 71 at one end thereof and is fixed to the movable plate 73 at the other end of the side plate 71.

The cam 75 is configured to be rotated in one direction by the rotary actuator 74 and to be rotated a predetermined rotational degree. Then, the movable plate 73 is pushed by the cam 75, and is moved by a predetermined amount of movement in a direction away from the side plate 71. At this time, the plurality of springs 76 is extended, and increases a restoring force thereof.

The rotary actuator 74 is configured to return to an initial position thereof after the operation of the side registration correction has finished. Then, the movable plate 73 returns to an initial position thereof by the restoring force of the plurality of springs 76.

As illustrated in FIG. 1 through FIG. 3, the movable plate 73 rotatably supports a shaft 39*a* and a shaft 38*a* which are shafts of the relay roller pair 39 and the registration roller pair 38 serving as the first sheet conveyance part, and rotatably supports shafts 60*a* of the plurality of conveying roller pairs 60 serving as the second sheet conveyance part.

The movable plate 73 holds a motor 40 which is controlled by the main body controller 90 to rotate. The motor transmits a driving force to the shaft 39*a* and the shaft 38*a* via a gear train 41 and rotates the shafts 39*a* and 38*a*. Similarly, another motor transmits a driving force to the shafts 60*a* of the plurality of conveying roller pairs 60 via another gear train and rotates the shafts 60*a*.

Accordingly, the side registration correcting mechanism 70 is configured to simultaneously move all of the relay roller pairs 39 and the registration roller pairs 38, which are conveying the sheet S for printing on the second face, and the plurality of conveying roller pairs 60, the movement thereof is to be a predetermined amount in a horizontal direction perpendicular to the sheet conveying direction.

By this configuration, the side registration correcting mechanism 70 is able to accurately correspond/align a start position of printing on the second face of the sheet relative to an image printed on the first face of the sheet. The side registration correcting mechanism 70 is configured to return to the initial position thereof after finishing conveying the sheet.

The side position detector 80 (side end detector) including a CIS (Contact Image Sensor) is disposed nearby on a downstream side relative to the registration roller pair 38 in the sheet conveying direction. The main body controller 90 is configured to output a read instruction signal to the side position detector 80 based on a detection signal from the first sensor 81. The first sensor 81 is disposed at a predetermined position and is configured to detect a position of a rear end of the sheet in the sheet conveying direction. The side position detector 80 is configured to detect a rear end side of a side end of the first face of the sheet S in the sheet conveying direction, and the side end is disposed at a distant side from the movable plate 73. The side position detector 80 is configured to detect a first side position P1 which is a distance between the side end and a reference position P0 in the first face of the sheet S.

The main body controller 90 is configured to output a read instruction signal to the side position detector 80 based on a detection signal from the second sensor 82. The second sensor 82 is disposed at a predetermined position and is configured to detect a position of a front end of the sheet in the sheet conveying direction. The side position detector 80 is configured to detect a front end side of a side end of the second face of the sheet S in the sheet conveying direction, and the side end is disposed at the distant (opposite) side from the movable plate 73. The side position detector 80 is configured to detect a second side position P2 which is a distance between the side end and the reference position P0 in the second face of the sheet S.

After the sheet S is conveyed in the first face thereof as illustrated in FIG. 1, the sheet S is conveyed in the second face thereof as illustrated in FIG. 2. Then, as illustrated in FIG. 3, the positions of the sheet S in the first and second face are shifted from each other (do not align), because of a mechanical inaccuracy of the conveyance passage, unevenness of a diameter of the plurality of the roller pairs, a slipping at a roller nip, and so on. Consequently, a deviation ΔX between the first side position P1 and the second side position P2 is caused.

Further, the position of the first sensor 81 can be adjusted to the downstream side relative to the side position detector 80 in the sheet conveying direction. The position of the second sensor 82 can be adjusted thereof to the upstream side relative to the side position detector 80 in the sheet conveying direction.

The side position memory 97 (side end memory) is configured to store the first side position P1 and the second side position P2 of the sheet S which are detected by the side position detector 80. A rotary encoder attached to the rotary actuator 74 is configured to output a rotation angle from an origin position which is corresponding to the deviation ΔX of the sheet S. Further, the side position memory 97 is configured to store a data table of the rotation angles which are measured by the rotary encoder in advance.

The main body controller 90 is configured to calculate the deviation ΔX of the sheet S based on the first side position P1 and the second side position P2 which are stored in the side position memory 97. The main body controller 90 is configured to set the deviation ΔX as a side registration correction amount of the movable plate 73 of the side registration correcting mechanism 70.

The main body controller 90 is configured to operate the side registration correcting mechanism 70 to move the first sheet conveyance part 37 and second sheet conveyance part 60 by the side registration correction amount while the first sheet conveyance part 37 is conveying the reversed sheet S.

Figure 6:
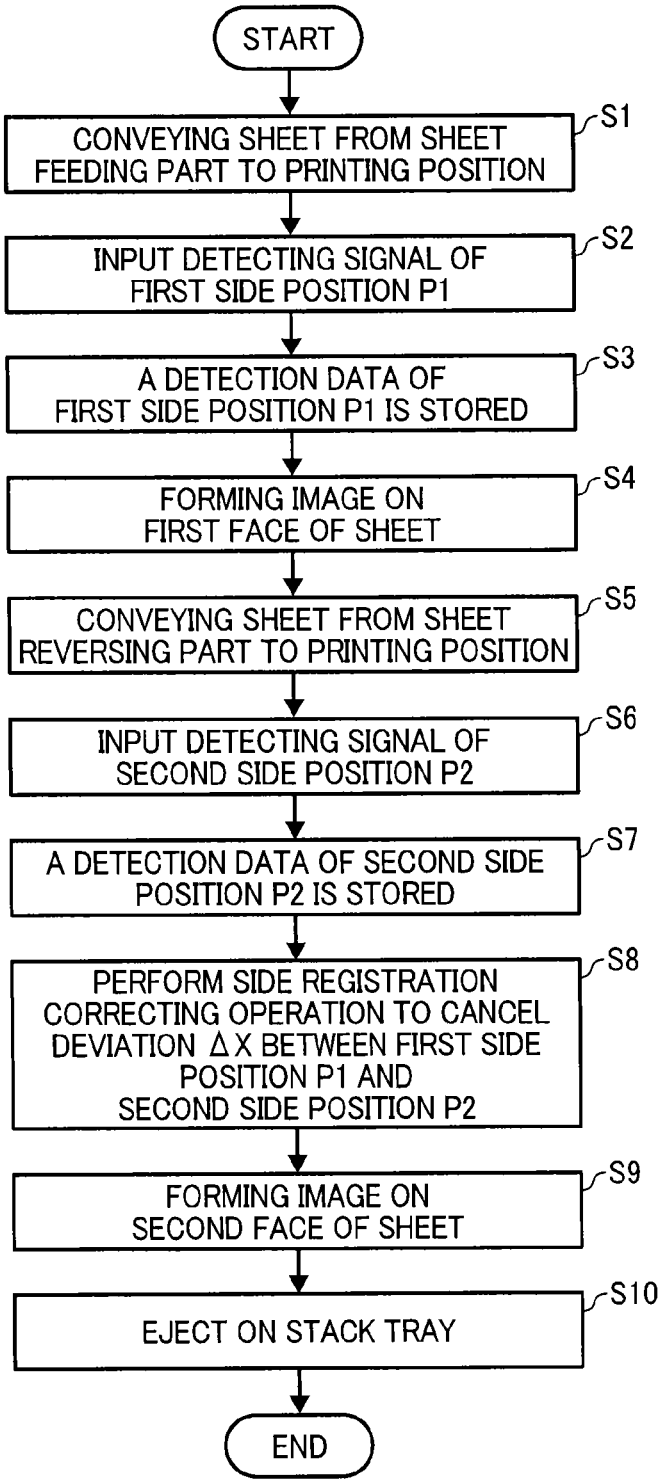
FIG. 6 is a schematic flowchart of a side registration correcting operation which the main body controller of the image forming apparatus in the first embodiment performs in a duplex printing mode.

FIG. 6 is a schematic flowchart of the side registration correcting operation which the main body controller 90 performs based on the program in a duplex printing mode.

The main body controller 90 starts the program, and operates such that each of the pick-up roller 34 and the feed roller pair 35 disposed in the one of sheet hoppers 31, 32, 33 selected by a user for use, the plurality of roller pairs 36, the relay roller pair 39, and the registration roller pair 38 rotate intermittently by a predetermined time lag.

Consequently, the main body controller 90 performs an operation which is conveying the sheet S from the sheet feeding part 30 to the printing position by controlling these related parts such that they are conveying the sheet S to the printing position (STEP S1).

Next, the main body controller 90 inputs a detection signal of the first side position P1 disposed at a distant side from the movable plate 73, which is a rear end side of the first face of the sheet S in the sheet conveying direction, by detecting the rear end side of a side end of the first face of the sheet S in the sheet conveying direction with the side position detector 80 when the first sensor 81 inputs a detection signal to the main body controller 90 (STEP S2).

Next, the main body controller 90 inputs the detection signal of the first side position P1 to the side position memory 97 and a detection data of the first side position P1 is stored in the side position memory 97 (STEP S3).

Next, the main body controller 90 controls a plurality of functionally-related parts such that the image forming part 10 forms the layered image including four colors for the first face of the sheet S on the intermediate transfer belt 18, and the layered image is transferred on the first face of sheet S which is conveyed to the secondary transferring position by the registration roller pair 38 by a secondary transferring, and the transferred image is fixed on the first face of sheet S by the fixing device 46. Each timing of operations of these functionally-related parts is adjusted to the sheet feeding operation described above (STEP S4).

Next, the main body controller 90 controls such that the end portion 51*a* is positioned on an upper side relative to the sheet conveyance surface (virtual surface) of the most upstream one of the plurality of guiding roller pairs 53 in the sheet conveying direction, and the sheet S is conveyed toward the switch back roller pair 52, and the switch back roller pair 52 stops to rotate before the sheet S passes through the switch back roller pair 52, and then the switch back roller pair 52 starts to rotate in counter direction.

The main body controller 90 controls such that the reversed sheet S is conveyed to the first sheet conveyance part 37 by the plurality of conveying roller pairs 60 serving as the second sheet conveyance part. Subsequently the sheet S is conveyed by the relay roller pair 39 and the registration roller pair 38 to the printing position.

Consequently, the main body controller 90 performs an operation which is conveying the sheet S from the sheet reversing part 50 to the printing position by controlling these parts (STEP S5).

Next, the main body controller 90 inputs a detection signal of the second side position P2 disposed at a distant side from the movable plate 73, which is a front end side of the second face of the sheet S in the sheet conveying direction, by detecting the front end side of a side end of the second face of the sheet S in the sheet conveying direction with the side position detector 80 when the second sensor 82 inputs a detection signal to the main body controller 90 (STEP S6).

Next, the main body controller 90 inputs the detection signal of the second side position P2 to the side position memory 97 and a detection data of the second side position P2 is stored in the side position memory 97 (STEP S7).

Next, the main body controller 90 calculates the deviation ΔX (see FIG. 3) of the sheet S based on the first side position P1 and the second side position P2 which are stored in the side position memory 97. The main body controller 90 sets the deviation ΔX as a side registration correction amount of the side registration correcting mechanism 70. The main body controller 90 reads out the rotation angle of the rotary actuator 74 which is corresponding to the deviation ΔX of the sheet S from the data table stored in the side position memory 97.

The main body controller 90 performs control such that the rotary actuator 74 is only rotated by the rotation angle.

Consequently, the main body controller 90 controls the movement of the side registration correcting mechanism 70 such that the deviation ΔX of the sheet S is eliminated/accounted for by the rotation of the rotary actuator 74, while each of the first sheet conveyance part (including the relay roller pair 39 and the registration roller pair 38) and the second sheet conveyance part (including the plurality of conveying roller pairs 60) only conveys by a deviation ΔY (see FIG. 3) (STEP S8).

Accordingly, the second face of the sheet S is overlapped with the first face of the sheet S by moving diagonally indicated by arrow A in FIG. 3, and the second side position P2 is accurately aligned to the first side position P1.

Namely, the sheet S is reversed when printing on the second face. With regard to the position detection of the side end of the sheet S, the first side position P1 is detected at the rear side of the sheet S, and the second side position P2 is detected at the front side of the sheet S.

Consequently, the main body controller 90 controls the movement of the side registration correcting mechanism 70 such that the rear side of the first side position P1 corresponds to (aligns with) the front side of the second side position P2. Thus, it is possible to accurately align the positions of images on both faces of the sheet S.

As illustrated in the FIG. 3 and FIG. 4, a former position of the registration roller pair 38, the relay roller pair 39, and the plurality of conveying roller pair 60 is drawn by solid line before they are shifted. As illustrated in the FIG. 3, when the registration roller pair 38, the relay roller pair 39, and the plurality of conveying roller pair 60 are shifted by the side registration correcting mechanism 70, the sheet S is moving diagonally indicated by arrow A, and then, the second side position P2 accurately corresponds to (aligns with) the first side position P1.

Next, the main body controller 90 controls a plurality of functionally-related parts such that the image forming part 10 forms the layered image including four colors for the second face of the sheet S on the intermediate transfer belt 18, and the layered image is transferred on the second face of sheet S which is conveyed to the secondary transferring position by the registration roller pair 38 by a secondary transferring, and the transferred image is fixed on the second face of sheet S by the fixing device 46. Each timing of operations of these parts is adjusted to the operation which is conveying the sheet S to a sheet reversing position and the printing position (STEP S9).

Next, the main body controller 90 controls the bifurcating claw 51 such that the end portion 51*a* of the bifurcating claw 51 is positioned lower relative to a sheet conveyance surface (virtual surface) of the most upstream one of the plurality of guiding roller pairs 53 in the sheet conveying direction, and controls the ejecting roller pair 54 to rotate. Accordingly, the sheet S is conveyed over the bifurcating claw 51 and toward the ejecting roller pair 54, and is ejected on the stack tray 55 by the ejecting roller pair 54 (STEP S10).

Consequently, the main body controller 90 is configured to repeat STEP S1 through the STEP S10 as described above according to the number of printing sheets.

As described above and as illustrated in FIG. 1, the movable plate 73, which includes a single plate, rotatably supports the shaft 39*a* and the shaft 38*a* which are shafts of the relay roller pair 39 and the registration roller pair 38 serving as the first sheet conveyance part, and rotatably supports the shafts 60*a* of the plurality of conveying roller pairs 60 serving as the second sheet conveyance part.

Accordingly, the movable plate 73 is large, and a stress of the mechanical structure is large, and thus, a large driving force is needed to move the mechanical structure. To this point, the mechanical structure of the first embodiment can be improved to move the plurality of conveying roller pairs 60 for the side registration correcting operation, even when the sheet S is not held by a plurality of conveying roller pairs 60 because of a length of the sheet S is not so long in the sheet conveying direction.

The first sheet conveyance part 37 and the second sheet conveyance part 60 are independently controlled to rotate by the main body controller 90. For this reason, it becomes easier to assemble the mechanical structure when the mechanical structure is separated into two parts: one part that supports and moves the shaft 39*a* and the shaft 38*a*, and another part that supports and moves the shafts 60*a*. As a result, it becomes easier to move the movable plate 73.

Therefore, in the second embodiment of the disclosure as described below, the mechanical part for the side registration correcting operation is separated into a first mechanical part, which relates to the first sheet conveyance part 37, and a second mechanical part, which relates to the second sheet conveyance part 60.

In the descriptions of the second embodiment, the same components or components with the same functions as the components of the printer 1 of the first embodiment are denoted by the same reference symbols. The characteristic components of the printer 1A of the second embodiment, which are different from the components of the printer 1 of the first embodiment, are explained below.

Second Embodiment

Referring to FIG. 7 through FIG. 10, a printer 1A according to the second embodiment includes, inside the casing 2, the image forming part 10, the sheet feeding part 30, the first sheet conveyance part 37, the fixing device 46, the sheet reversing part 50, and the second sheet conveyance part 60.

Further, the printer 1A includes a plurality of characteristic parts which include a side registration correcting mechanism 70A serving as a correction mechanism, the side position detector 80 serving as the side end detector, and a main body controller 90A serving as a controller. The side registration correcting mechanism 70A is separated upward and downward to the first mechanical part which relates to the first sheet conveyance part 37 and the second mechanical part which relates to the second sheet conveyance part 60. A detailed explanation is given below.

Figure 7:
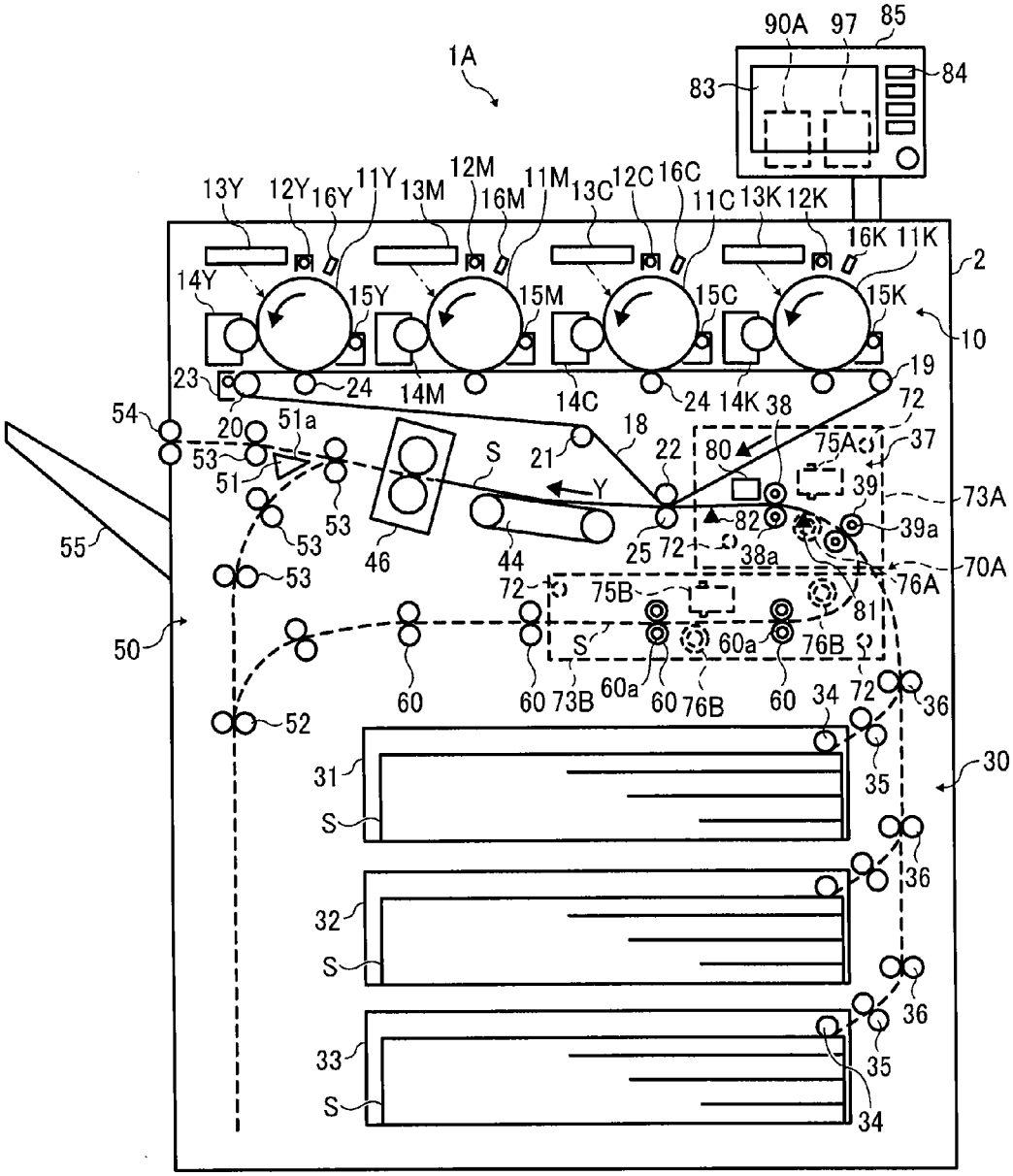
FIG. 7 is a schematic cross-sectional view of an image forming apparatus according to a second embodiment is in one state of an operation.

As illustrated in FIG. 7, the image forming part 10 includes photoconductors 11Y, 11M, 11C, 11K serving as the image bearers corresponding to four colors which are disposed along the upper surface of the intermediate transfer belt 18. Further, the image forming part 10 includes the toner image forming parts 12, 13, 14, 15, 16 which are forming visible images for each color, the intermediate transfer belt 18 serving as the intermediate transfer medium which transfers the visible images from each of the photoconductors 11Y, 11M, 11C, 11K, and the secondary transfer roller 25 which transfers the layered image, that is layered four colors of visible images, on the sheet S serving as the recording medium. In the drawings and the descriptions, Y, M, C, and K are symbols appended to components corresponding to yellow, magenta, cyan, and black, respectively, and will be omitted appropriately.

The toner image forming parts 12, 13, 14, 15, 16 are arranged in the rotational direction of the photoconductor 11 in this order. The toner image forming parts 12, 13, 14, 15, 16 are, for example explained in the Yellow station representative of other colors, the charging device 12 serving as the charger which takes the charge to the surface of the photoconductor 11, the laser scanning device 13 serving as the exposing device, the developing device 14, the cleaning device 15 to clean the remaining toner on the surface of the photoconductor 11 after transferring, and the quenching lamp 16 serving as the neutralizer which neutralizes the charged surface of the photoconductor 11. The other color stations include the same configuration as the Yellow station. Each of primary transfer rollers 24 pushes the intermediate transfer belt 18 toward each of the photoconductors 11 corresponding to each of primary transfer rollers 24.

The intermediate transfer belt 18 is seamless and is wound around the first roller 19, the second roller 20, the third roller 21, and the fourth roller 22 serving as the plurality of support members and moves the rollers 19-22 around. The cleaning device 23 of the intermediate transfer belt is disposed at the position facing to the second roller 20. The secondary transfer roller 25, which is driven, is disposed below the fourth roller 22 and pushes the sheet S toward the intermediate transfer belt 18.

The belt conveyor 44 is disposed at the downstream side of the secondary transfer roller 25 in the sheet conveying direction. Further the fixing device 46 fixes the visible toner image on the sheet S and is disposed at the downstream side of the belt conveyor 44 in the sheet conveying direction.

Accordingly, each color of the four toner images is formed on each of the surfaces of the photoconductors 11Y, 11M, 11C, 11K, and the four toner images are transferred on the outer surface of the intermediate transfer belt 18 by the primary transferring. As a result of the primary transferring, the four toner images are layered on the outer surface of the intermediate transfer belt 18. The layered image including four colors of toner images is transferred on the sheet S by the secondary transferring. After that, the layered image on the sheet S is fixed by heating and pressing of the fixing device 46. The printing operation of the image forming apparatus is performed in this sequence.

The sheet feeding part 30 includes first, second, third sheet hoppers 31, 32, 33 which are vertically disposed at the bottom side of the casing 2, and includes the plurality of roller pairs 36, 36, 36 serving as the vertical sheet conveyor which takes over the sheet S from one of the sheet hoppers upwardly convey the sheet S, and transfer the sheet S to the first sheet conveyance part 37. Each of the sheet hoppers includes the pick-up roller 34 which picks up the single sheet from the sheet hopper. The sheet S is not limited to plain paper, and may include thick paper, a postcard, an envelope, thin paper, coated paper, art paper, tracing paper, or the like. The sheet S may be an OHP (Over-Head Projector) sheet, an OHP films, or the like. In other words, the sheet S may be any type of recording medium capable of carrying the image thereon.

A user who operates the printer 1A selects one of sheet hoppers 31, 32, 33 which accommodates preferable sheet for user via the main body controller 90 or some input terminal such as a personal computer which is connected to a network and which is constructed in a system. Thereby, the sheet S which is accommodated in the selected one of sheet hoppers 31, 32, 33 and is conveyed upwardly to the first sheet conveyance part 37, which is disposed on the downstream side in the sheet conveying direction.

The image forming position where the layered image on the intermediate transfer belt 18 is transferred to the sheet S is, in other words, the secondary transferring position where the secondary transfer roller 25 and the intermediate transfer belt 18 form the contact nip. The first sheet conveyance part 37 is disposed on the upstream side relative to the secondary transferring position in the sheet conveying direction and is on the virtual surface which extends horizontally from the contact nip. The first sheet conveyance part 37 includes the registration roller pair 38 and the relay roller pair 39 which is disposed on the upstream side relative to the registration roller pair 38 in the sheet conveying direction.

The registration roller pair 38 and the relay roller pair 39 are configured to rotate intermittently, and to sequentially receive the sheet S which is sequentially conveyed from the plurality of roller pairs 36 and to convey along the sheet conveying direction toward the secondary transferring position.

The sheet reversing part 50 includes the plurality of guiding roller pairs 53, the bifurcating claw 51, and the switch back roller pair 52. The plurality of guiding roller pairs 53 is disposed on the downstream side relative to the fixing device 46 in the sheet conveying direction. A pair of the plurality of guiding roller pairs 53 is arranged almost horizontally and the other pair of the plurality of guiding roller pairs 53 is arranged almost vertically downward from the fixing device 46. The bifurcating claw 51 is disposed at a position just downstream of the most upstream pair of the plurality of guiding roller pairs 53 in the sheet conveying direction. The switch back roller pair 52 is disposed downwardly relative to the most downward pair of the plurality of guiding roller pairs 53.

The switch back roller pair 52 is configured to intermittently rotate, corresponding to a conveyance of the sheet S, in one rotational direction and in the other rotational direction. The plurality of guiding roller pairs 53 is configured to rotate intermittently corresponding to the conveyance of the sheet S.

The bifurcating claw 51 is formed in the wedge-shape by the upper inclined surface and the lower inclined surface thereof. The end portion 51*a* which is the tip portion of the wedge-shape faces the upstream side in the sheet conveying direction. The bifurcating claw 51 is configured to move the end portion 51*a* up and down by the actuator. In the simplex printing mode, the end portion 51*a* of the bifurcating claw 51 is moved down by the actuator. Then, the end portion 51*a* is positioned below/lower relative to a sheet conveyance surface (virtual surface) of the most upstream pair of the plurality of guiding roller pairs 53 in the sheet conveying direction.

Accordingly, the sheet S is conveyed over the upper inclined surface of the bifurcating claw 51 and toward to the plurality of guiding roller pairs 53 and the ejecting roller pair 54 at the downstream in the sheet conveying direction. The sheet S is ejected on the stack tray 55 by the ejecting roller pair 54.

Meanwhile, in the duplex printing mode, the end portion 51*a* is positioned higher relative to the sheet conveyance surface (virtual surface) of the most upstream pair of the plurality of guiding roller pairs 53 in the sheet conveying direction until printing the first face of the duplex printing is finished. The end portion 51*a* is positioned below/lower relative to the sheet conveyance surface (virtual surface) of the most upstream pair of the plurality of guiding roller pairs 53 in the sheet conveying direction until printing the second face of the duplex printing is finished.

Accordingly, after printing the first face of the duplex printing, the sheet S is conveyed under the lower inclined surface of the bifurcating claw 51 and toward the switch back roller pair 52. Before the sheet S passes through the switch back roller pair 52, the switch back roller pair 52 stops rotating, and then, the switch back roller pair 52 starts rotating in the counter direction. Consequently, the sheet S (which is upside down) is conveyed horizontally toward the second sheet conveyance part 60. Further, after printing the second face of the duplex printing, in the same manner as the simplex printing mode, the end portion 51*a* is positioned below/lower relative to the sheet conveyance surface (virtual surface) of the most upstream pair of the plurality of guiding roller pairs 53 in the sheet conveying direction.

The second sheet conveyance part 60 includes the plurality of conveying roller pairs (hereinafter, referred to as "the conveying roller pair 60") which is arranged along the sheet conveyance surface parallel to the sheet conveyance surface formed at the contact nip of secondary transferring, which is disposed lower than the contact nip, and which is configured to rotate intermittently.

The plurality of conveying roller pairs 60 receives the sheet S which is reversed from the switch back roller pair 52 and conveys so as to pass the sheet S to the first sheet conveyance part 37, which includes the registration roller pair 38 and the relay roller pair 39.

Consequently, in the simplex printing mode, the sheet S in the selected one of sheet hoppers 31, 32, 33 is picked up by the pick-up roller 34 and the feed roller pair 35 and is conveyed upwardly by the plurality of roller pairs 36.

Subsequently, the sheet S is conveyed by the relay roller pair 39 and the registration roller pair 38 toward the contact nip and is pressed by the secondary transfer roller 25 at the contact nip with the intermediate transfer belt 18 and transfers the layered image (including four colors of toner images) on the intermediate transfer belt 18 by the secondary transferring. After that, the layered image on the sheet S is fixed by the fixing device 46 and the sheet S is ejected on the stack tray 55.

Meanwhile, in the duplex printing mode, in the same manner as the simplex printing mode, at first, the sheet S is printed on the first face (see FIG. 7). After that, the sheet S is reversed by the sheet reversing part 50 and is subsequently conveyed by the plurality of conveying roller pairs 60. Next, the sheet S is subsequently conveyed by the first sheet conveyance part 37, which includes the relay roller pair 39 and the registration roller pair 38 (see FIG. 8).

Further after that, similar to the simplex printing mode described above, the second face of the duplex printing that includes the layered image (including four colors of toner images) is transferred on the intermediate transfer belt 18 by the secondary transferring. After that, the layered image on the second face is fixed by the fixing device 46 and the sheet S is ejected on the stack tray 55.

Figure 11:
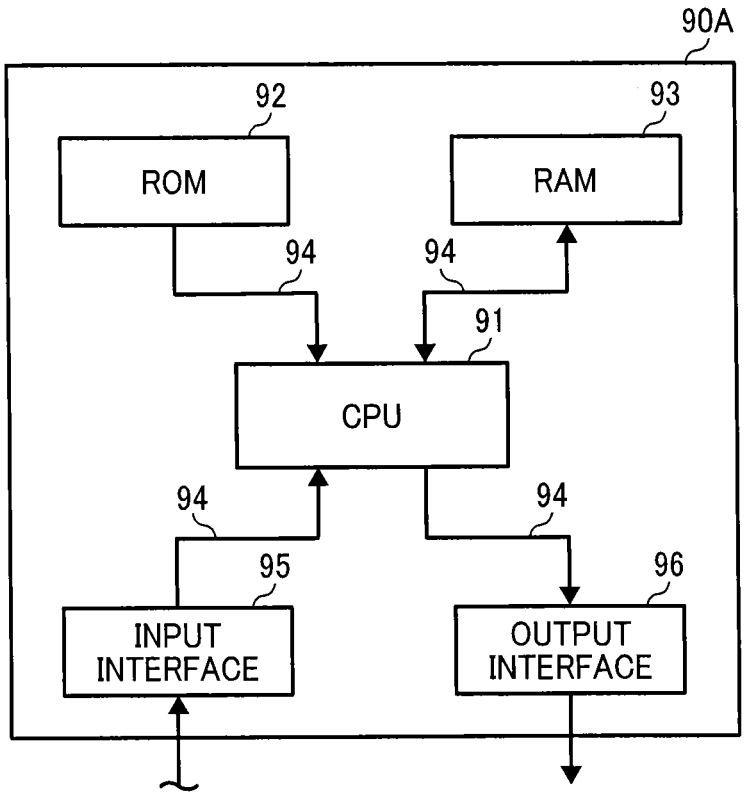
FIG. 11 is a block diagram of the main body controller of the image forming apparatus in the second embodiment.
Figure 12:
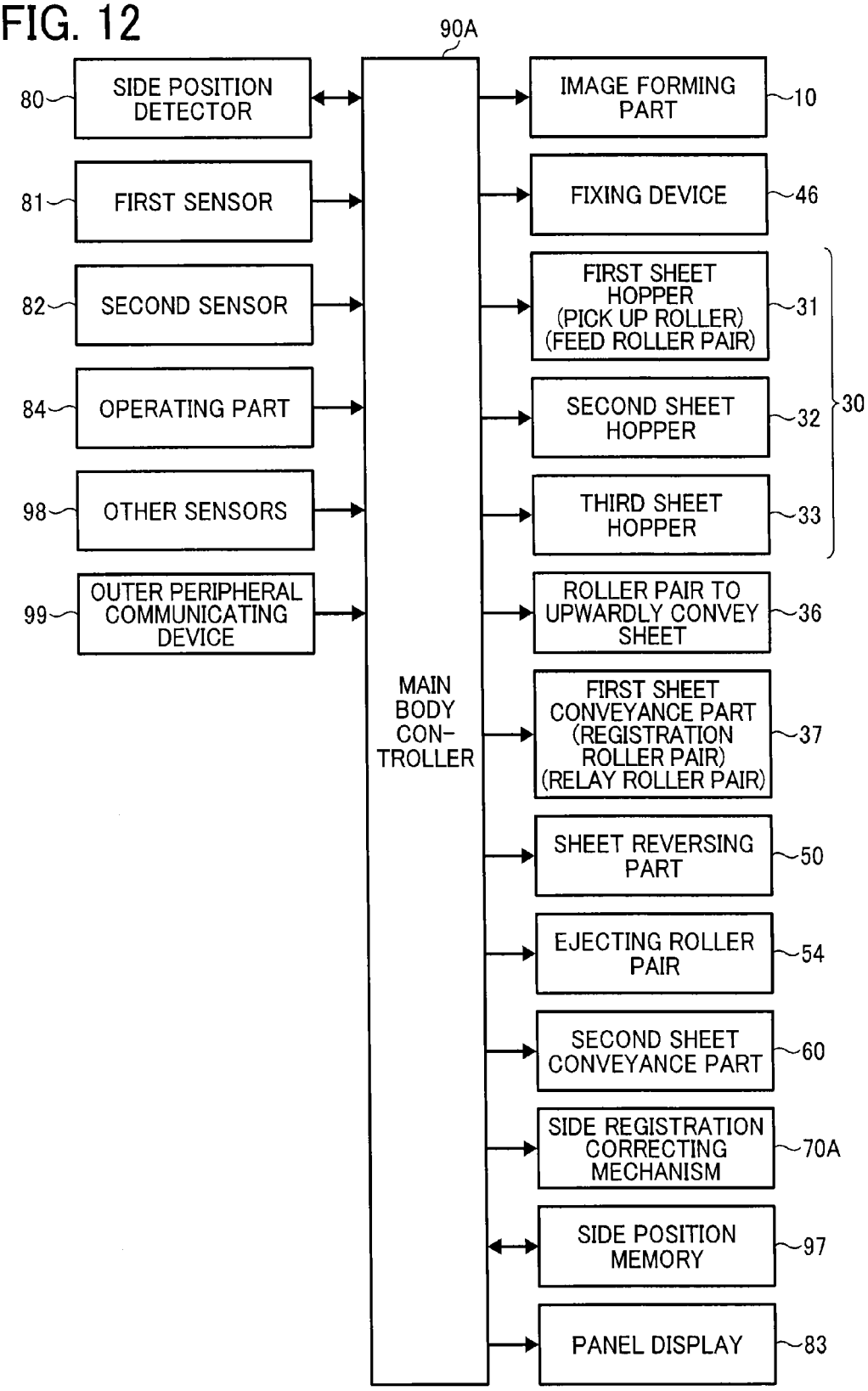
FIG. 12 is a block diagram of the image forming apparatus in the second embodiment.

FIG. 11 is a block diagram of the main body controller 90A of the printer 1A, and FIG. 12 is a block diagram of the overall printer 1A. The main body controller 90A serves as a controller in the present disclosure.

As illustrated in FIG. 11, the main body controller 90A includes the CPU 91 (Central Processing Unit), the ROM 92 (Read Only Memory) which stores the fixed data, the RAM 93 (Random Access Memory) which stores the temporary data, the INPUT interface 95, and the OUTPUT interface 96.

The ROM 92 stores programs for which the CPU 91 performs operations. The RAM 93 functions as the work area which is used by the CPU 91 when the CPU 91 performs operations. The main body controller 90A can include communication capabilities. The main body controller 90A is configured to control all operations in the printer 1A.

For example, the ROM 92, serving as the memory, stores the program that is used for controlling the printer 1A including the side registration correcting operation in the second embodiment. The CPU 91 is configured to perform the arithmetic processing based on the program which is stored in the ROM 92. The RAM 93 is configured to temporary store the result of the arithmetic processing of the CPU 91, the data which is inputted from the operating part 84 (described later), etc.

The CPU 91, the ROM 92, and the RAM 93 are connected with each other via the bus 94 and are connected with the INPUT interface 95 and the OUTPUT interface 96.

Figure 10:
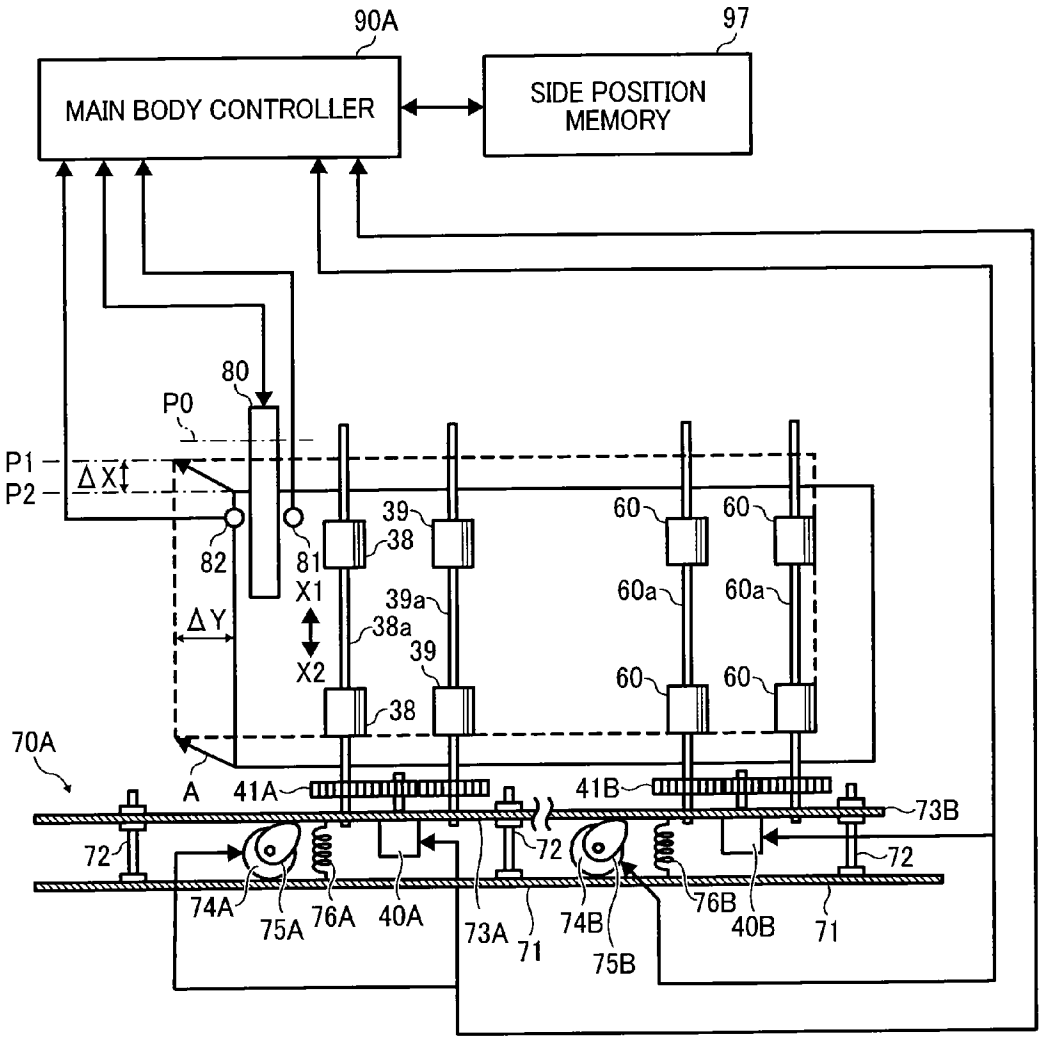
FIG. 10 is a schematic plan view of a side registration correcting mechanism of the image forming apparatus illustrated in FIG. 7 which includes a block diagram for explaining the side registration correcting operation in printing a second face of the duplex printing.

In FIG. 10 and FIG. 12, the main body controller 90A (in particular, the INPUT interface 95) is connected with the side position detector 80 (side end detector), the first sensor 81, the second sensor 82, the operating part 84, other sensors 98, and the outer peripheral communicating device 99. The INPUT interface 95 is input detection signals and instruction signals from the devices with which it is connected.

Further, the main body controller 90A (in particular, the OUTPUT interface 96) is connected with each of the object parts that are the image forming part 10, the fixing device 46, the sheet feeding part 30 which includes first, second, third feeding hoppers 31, 32, 33, the roller pair 36, the first sheet conveyance part 37, the sheet reversing part 50, the ejecting roller pair 54, the second sheet conveyance part 60, the side registration correcting mechanism 70A, and the side position memory 97 (side end memory). Further, the OUTPUT interface 96 is connected with the panel display 83.

The side position memory 97 is also connected with the INPUT interface 95. The main body controller 90A is configured to perform the arithmetic processing based on the detection signals which are input via the INPUT interface 95, and is configured to perform various operations, which correspond to each of the object parts, via the OUTPUT interface 96.

The side position memory 97 includes the nonvolatile memory and is configured to store position data which includes the position P1 of side end of sheet in first face and the position P2 of side end of sheet in second face. The side position memory 97 can be included in the main body controller 90A.

In the second embodiment, as illustrated in FIG. 7, the input display device 85 is disposed above the casing 2 of printer 1A. The input display device 85 includes the panel display 83, the operating part 84, the main body controller 90A, and the side position memory 97, all together.

In the second embodiment, the side registration correction in the duplex printing mode is performed. The side registration correction in the second embodiment is described later by referring to FIG. 7 through FIG. 13.

The meaning of "the side registration correction" is to correct relative positions of images formed on both faces of the sheet S in the duplex printing mode. In other words, the meaning of "the side registration correction" is to reduce the position difference between the image formed on the first face of the sheet S and the image formed on the second face of the sheet S. In the case that the position difference of the relative positions of images is lower, the position accuracy (two side accuracy) of the relative positions of images is higher. The side registration correction is to be performed only in the duplex printing mode, and not to be performed in the simplex printing mode.

Figure 9:
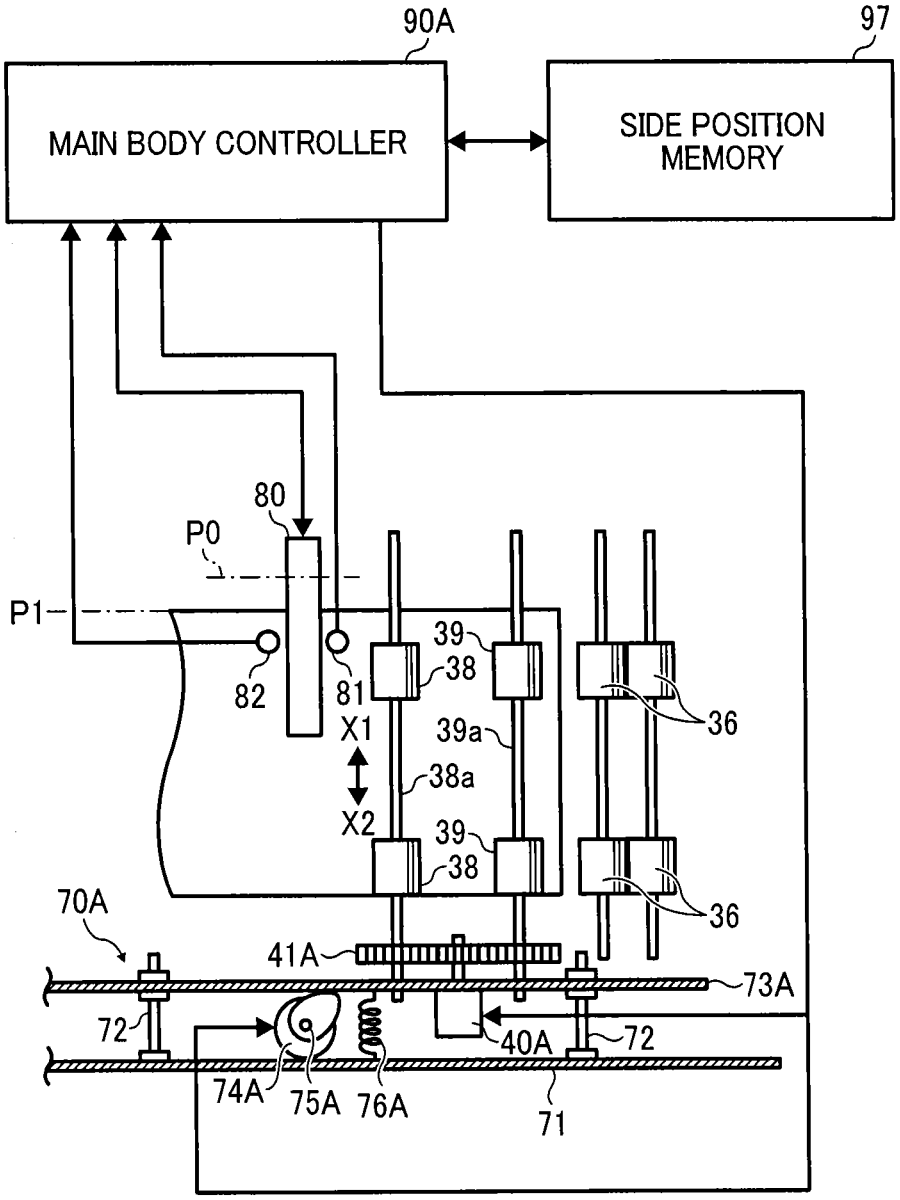
FIG. 9 is a schematic plan view of a side registration correcting mechanism of the image forming apparatus illustrated in FIG. 7 which includes a block diagram for explaining a side registration correcting operation in printing a first face of a duplex printing.

FIG. 9 is a schematic plan view of the side registration correcting mechanism 70A of the printer 1A and includes a block diagram that is the main body controller 90A and performs an operation of the side registration correction on the first face of the duplex printing mode.

FIG. 10 is a schematic plan view of the side registration correcting mechanism 70A of the printer 1A and includes a block diagram that is the main body controller 90A and performs the operation of the side registration correction on the second face of the duplex printing mode.

The side registration correction of the printer 1A in the second embodiment is configured to work by a cooperation of the side registration correcting mechanism 70A, the side position detector 80 (side end detector), the first sensor 81, the second sensor 82, and the main body controller 90A.

As illustrated in FIG. 9 and FIG. 10, the side registration correcting mechanism 70A includes the side plate 71, which is formed in a vertical face shape along the sheet conveyance passage, which is fixed on the side of the sheet conveyance passage where printing is performed, and which is disposed inside of the casing 2.

The side registration correcting mechanism 70A includes the plurality of guide 72 and movable plates 73A, 73B which are separated into an upper portion and a lower portion. Specifically, the movable plates 73A, 73B include a first movable plate 73A (first plate) and a second movable plate 73B (second plate). The plurality of guides 72 are configured to guide each of the movable plates 73A, 73B such that both of the movable plates 73A, 73B are parallel to the side plate 71 between the side plate 71 and the sheet conveyance passage. The plurality of guide 72 are fixed to the side plate 71 at one end thereof, and the other end thereof protrude to a direction perpendicular to the sheet conveying direction.

Further, the side registration correcting mechanism 70A includes a rotary actuator 74A, a cam 75A (eccentricity cam), and a plurality of springs 76A. The rotary actuator 74A is fixed to the side plate 71 between the side plate 71 and the first movable plate 73A which is the upper plate of the movable plates 73A, 73B. The cam 75A is fixed to an output shaft of the rotary actuator 74A. The plurality of springs 76A is fixed to the side plate 71 at one end thereof and is fixed to the first movable plate 73A at the other end thereof.

The side registration correcting mechanism 70B includes a rotary actuator 74B, a cam 75B (eccentricity cam), and a plurality of springs 76B. The rotary actuator 74B is fixed to the side plate 71 between the side plate 71 and the second movable plate 73B which is the lower plate of the movable plates 73A, 73B. The cam 75B is fixed to an output shaft of the rotary actuator 74B. The plurality of springs 76B is fixed to the side plate 71 at one end thereof and is fixed to the second movable plate 73B at the other end thereof.

Each of the cams 75A, 75B is configured to be rotated in one direction by the respective rotary actuator 74A, 74B which are synchronously controlled by the main body controller 90A and be rotated by a predetermined rotational degree. Then, the movable plates 73A, 73B are pushed by the cams 75A, 75B, and are moved by a predetermined amount of movement in a direction away from the side plate 71.

At this time, the plurality of springs 76A, 76B are extended, and increase a restoring force thereof. The rotary actuators 74A, 74B are configured to return to initial positions thereof after the operation of the side registration correction has finished. Then, the movable plates 73A, 73B return to the initial positions thereof by the restoring force of the plurality of springs 76A, 76B.

In addition, in a case that a length of the sheet S is shorter in the sheet conveying direction than a length that is of sufficient length to be held by the plurality of conveying roller pairs 60 when the main body controller 90A performs the operation of the side registration correction, it is possible not to drive the rotary actuator 74B which is a the lower actuator of the rotary actuators 74A, 74B.

As illustrated in FIG. 7 and FIG. 9, the first movable plate 73A rotatably supports a shaft 39*a* and a shaft 38*a* which are shafts of the relay roller pair 39 and the registration roller pair 38 serving as the first sheet conveyance part. The first movable plate 73A holds a motor 40A which is controlled to rotate by the main body controller 90A. The motor 40A transmits a driving force to the shaft 39*a* and the shaft 38*a* via a gear train 41A and rotates them.

As illustrated in FIG. 7 and FIG. 10, the second movable plate 73B rotatably supports the shafts 60*a* of the plurality of conveying roller pairs 60 serving as the second sheet conveyance part. The second movable plate 73B holds a motor 40B which is controlled to rotate by the main body controller 90A. The motor 40B transmits a driving force to the shafts 60*a* via a gear train 41B and rotates them.

Accordingly, the side registration correcting mechanism 70A is configured to simultaneously move all of the relay roller pair 39 and the registration roller pair 38, which are conveying the sheet S for printing on the second face, and the plurality of conveying roller pairs 60, a predetermined amount in a horizontal direction perpendicular to the sheet conveying direction.

By this configuration, the side registration correcting mechanism 70A accurately aligns a start position of printing on the second face of the sheet S relative to an image printed on the first face of the sheet S. The side registration correcting mechanism 70A is configured to return to the initial position thereof after finishing conveying the sheet.

The side position detector 80 (side end detector) including the CIS (Contact Image Sensor) is disposed near/adjacent, on a downstream side, relative to the registration roller pair 38 in the sheet conveying direction. The main body controller 90A is configured to output a read instruction signal to the side position detector 80 based on a detection signal from the first sensor 81. The first sensor 81 is disposed at a predetermined position and is configured to detect a position of a rear end of the sheet S in the sheet conveying direction. The side position detector 80 is configured to detect a rear end side of a side end of the first face of the sheet S in the sheet conveying direction, and the side end is disposed at a distant side from the first movable plate 73A. The side position detector 80 is configured to detect a first side position P1 which is a distance between the side end and a reference position P0 in the first face of the sheet S.

The main body controller 90A is configured to output a read instruction signal to the side position detector 80 based on a detection signal from the second sensor 82. The second sensor 82 is disposed at a predetermined position and is configured to detect a position of a front end of the sheet in the sheet conveying direction. The side position detector 80 is configured to detect a front end side of a side end of the second face of the sheet S in the sheet conveying direction, and the side end is disposed at the distant side from the first movable plate 73A. The side position detector 80 is configured to detect a second side position P2 which is a distance between the side end and the reference position P0 in the second face of the sheet S.

Figure 8:
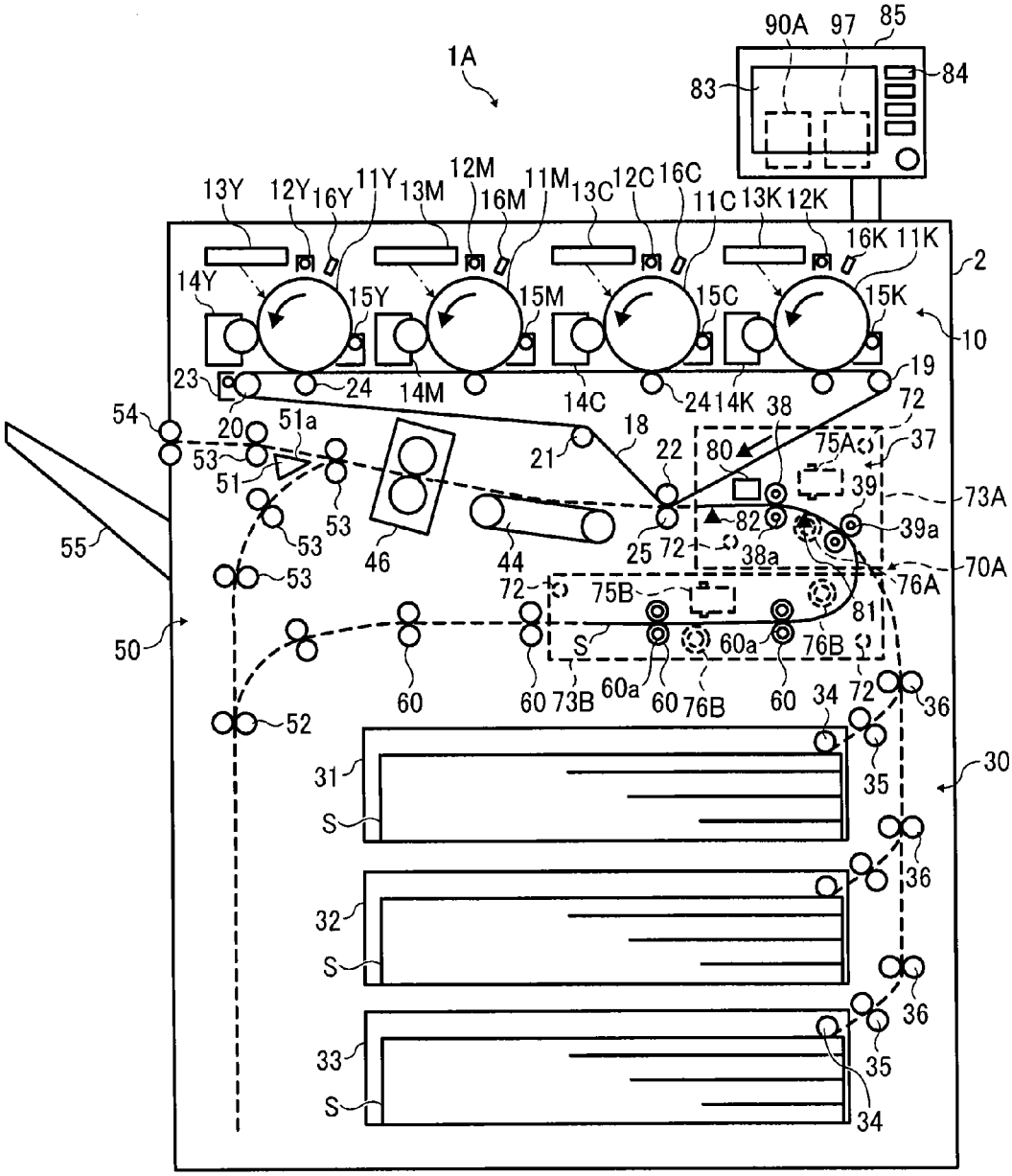
FIG. 8 is a schematic cross-sectional view of the image forming apparatus illustrated in FIG. 7 in another state of the operation.

After the sheet S is conveyed in the first face thereof as illustrated in FIG. 7, the sheet S is conveyed in the second face thereof as illustrated in FIG. 8. Then, as illustrated in FIG. 9, the positions of the sheet S in the first and second face are shifted from each other (do not align), because of a mechanical inaccuracy of the conveyance passage, unevenness of a diameter of the plurality of the roller pairs, a slipping at a roller nip, and so on. Consequently, a deviation ΔX between the first side position P1 and the second side position P2 is caused.

Further, the position of the first sensor 81 can be adjusted to the downstream side relative to the side position detector 80 in the sheet conveying direction. The position of the second sensor 82 can be adjusted to the upstream side relative to the side position detector 80 in the sheet conveying direction.

The side position memory 97 (side end memory) is configured to store the first side position P1 and the second side position P2 of the sheet S which are detected by the side position detector 80. A rotary encoder attached to the rotary actuator 74 is configured to output a rotation angle from an origin position which is corresponding to the deviation ΔX of the sheet S. Further, the side position memory 97 is configured to store a data table of the rotation angles which are measured by the rotary encoder in advance.

The main body controller 90A is configured to calculate the deviation ΔX of the sheet S based on the first side position P1 and the second side position P2 which are stored in the side position memory 97. The main body controller 90A is configured to set the deviation ΔX as side registration correction amounts of the movable plates 73A, 73B of the side registration correcting mechanism 70A.

The main body controller 90A is configured to operate the side registration correcting mechanism 70A to move the first sheet conveyance part 37 and second sheet conveyance part 60 by the side registration correction amount while the first sheet conveyance part 37 is conveying the reversed sheet S.

Figure 13:
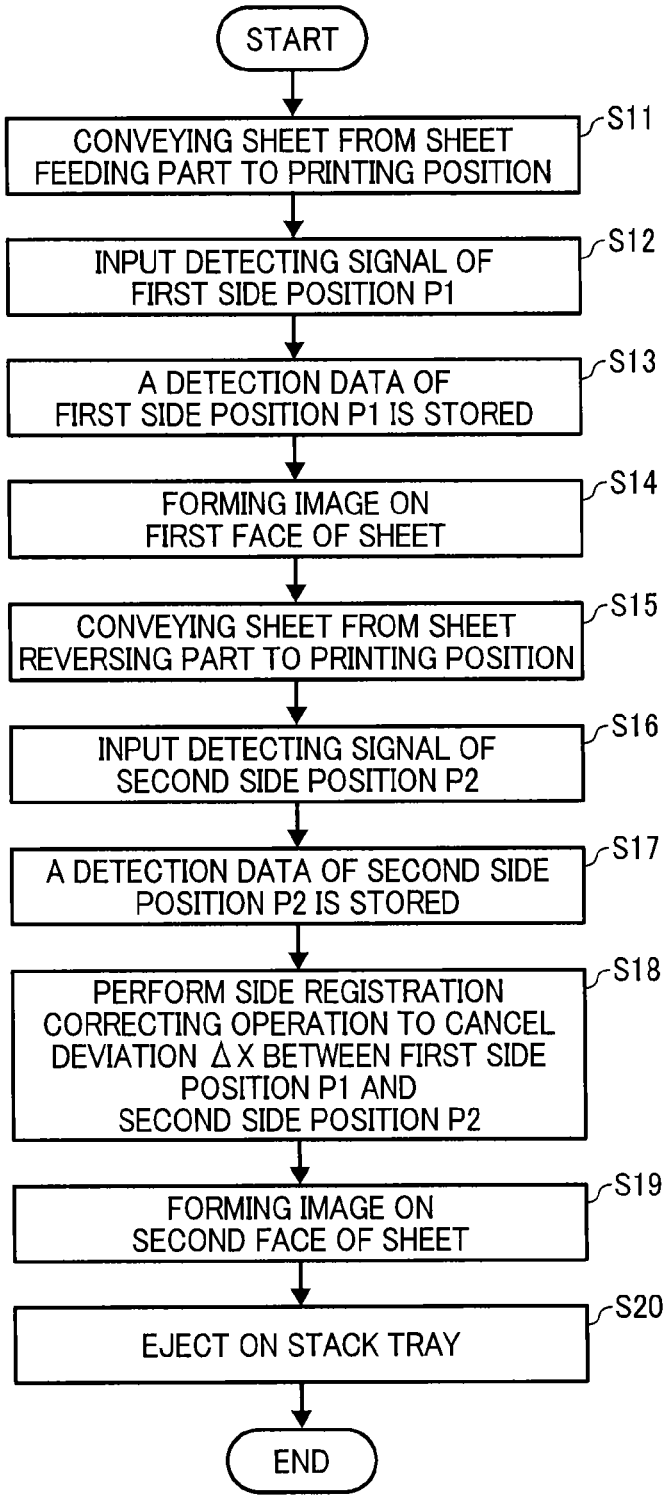
FIG. 13 is a schematic flowchart of the side registration correcting operation which the main body controller of the image forming apparatus in the second embodiment performs in the duplex printing mode.

FIG. 13 is a schematic flowchart of the side registration correcting operation which the main body controller 90A performs based on the program in a duplex printing mode.

The main body controller 90A starts the program and operates such that the pick-up roller 34 and the feed roller pair 35 disposed in the one of sheet hoppers 31, 32, 33 selected by a user for use, the plurality of roller pairs 36, the relay roller pair 39, and the registration roller pair 38 rotate intermittently by a predetermined time lag between each of them.

Consequently, the main body controller 90A performs an operation which is conveying the sheet S from the sheet feeding part 30 to the printing position by controlling these related operations such that they are conveying the sheet S to the printing position (STEP S11).

Next, the main body controller 90A inputs a detection signal of the first side position P1 disposed at a distant side from the first movable plate 73A, which is a rear end side of the first face of the sheet S in the sheet conveying direction, by detecting the rear end side of a side end of the first face of the sheet S in the sheet conveying direction with the side position detector 80 when the first sensor 81 inputs a detection signal to the main body controller 90A (STEP S12).

Next, the main body controller 90A inputs the detection signal of the first side position P1 to the side position memory 97 and a detection signal of the first side position P1 is stored in the side position memory 97 (STEP S13).

Next, the main body controller 90A controls a plurality of functionally-related parts such that the image forming part 10 forms the layered image including four colors for the first face of the sheet S on the intermediate transfer belt 18, and the layered image is transferred on the first face of sheet S which is conveyed to the secondary transferring position by the registration roller pair 38 by a secondary transferring, and the transferred image is fixed on the first face of sheet S by the fixing device 46. Each timing of operations of these functionally-related parts is adjusted to the sheet feeding operation described above (STEP S14).

Next, the main body controller 90A controls such that the end portion 51*a* is positioned on an upper side relative to the sheet conveyance surface (virtual surface) of the most upstream one of the plurality of guiding roller pairs 53 in the sheet conveying direction, and the sheet S is conveyed toward the switch back roller pair 52, and the switch back roller pair 52 stops rotating before the sheet S passes through the switch back roller pair 52, and the switch back roller pair 52 starts to rotate in counter direction.

The main body controller 90A controls such that the reversed sheet S is conveyed to the first sheet conveyance part 37 by the plurality of conveying roller pairs 60 serving as the second sheet conveyance part that is driven by the motor 40B. Subsequently the sheet S is conveyed to the printing position by the relay roller pair 39 and the registration roller pair 38 that are driven by the motor 40A.

Consequently, the main body controller 90A performs an operation conveying the sheet S from the sheet reversing part 50 to the printing position by controlling these related operations/parts (STEP S15).

Next, the main body controller 90A inputs a detection signal of the second side position P2 disposed at a distant side from the first movable plate 73A, which is a front end side of the second face of the sheet S in the sheet conveying direction, by detecting the front end side of a side end of the second face of the sheet S in the sheet conveying direction with the side position detector 80 when the second sensor 82 inputs a detection signal to the main body controller 90A (STEP S16).

Next, the main body controller 90A inputs the detection signal of the second side position P2 to the side position memory 97 and a detection signal of the second side position P2 is stored in the side position memory 97 (STEP S17).

Next, the main body controller 90A calculates the deviation ΔX (see FIG. 10) of the sheet S based on the first side position P1 and the second side position P2 which are stored in the side position memory 97. The main body controller 90A sets the deviation ΔX as a side registration correction amount of the side registration correcting mechanism 70A. The main body controller 90A read out the rotation angle of the rotary actuator 74 which corresponds to the deviation ΔX of the sheet S from the data table stored in the side position memory 97.

The main body controller 90A controls the rotary actuator 74 to only rotate by the rotation angle.

Consequently, the main body controller 90A controls the movement of the side registration correcting mechanism 70A such that the deviation ΔX of the sheet S is eliminated by the rotation of the rotary actuator 74, while each of the first sheet conveyance part (including the relay roller pair 39 and the registration roller pair 38) and the second sheet conveyance part (including the plurality of conveying roller pairs 60) only conveys by a deviation ΔY (see FIG. 10) (STEP S18).

Accordingly, the second face of the sheet S overlaps the first face of the sheet S by moving diagonally in the direction indicated by arrow A in FIG. 10, and the second side position P2 is accurately aligned to the first side position P1.

Namely, the sheet S is reversed when printing on the second face. With regard to the position detection of the side end of the sheet S, the first side position P1 is detected at the rear side of the sheet S, and the second side position P2 is detected at the front side of the sheet S.

Consequently, the main body controller 90A controls the movement of the side registration correcting mechanism 70A such that the rear side of the first side position P1 corresponds to the front side of the second side position P2. Thus, it is possible to accurately align the positions of images on both of faces of the sheet S.

As illustrated in FIG. 9 and FIG. 10, a former position of the registration roller pair 38, the relay roller pair 39, and the plurality of conveying roller pairs 60 is drawn by a solid line before they are shifted. As illustrated in FIG. 9, when the registration roller pair 38, the relay roller pair 39, and the plurality of conveying roller pairs 60 are shifted by the side registration correcting mechanism 70A, the sheet S is moved diagonally as indicated by arrow A, and then, the second side position P2 is accurately aligned with the first side position P1 (shown by the broken line).

Next, the main body controller 90A controls a plurality of functionally-related parts such that the image forming part 10 forms the layered image including four colors for the second face of the sheet S on the intermediate transfer belt 18, and the layered image is transferred on the second face of sheet S which is conveyed to the secondary transferring position by the registration roller pair 38 by a secondary transferring, and the transferred image is fixed on the second face of sheet S by the fixing device 46. Each timing of operations of these functionally-related parts is adjusted to the operation which is conveying the sheet S to a sheet reversing position and the printing position (STEP S19).

Next, the main body controller 90A controls the bifurcating claw 51 such that the end portion 51*a* of the bifurcating claw 51 is positioned lower relative to a sheet conveyance surface (virtual surface) of the most upstream pair of the plurality of guiding roller pairs 53 in the sheet conveying direction, and controls the ejecting roller pair 54 to rotate. Accordingly, the sheet S is conveyed over the bifurcating claw 51 and toward the ejecting roller pair 54, and is ejected on the stack tray 55 by the ejecting roller pair 54 (STEP S20).

Consequently, the main body controller 90A is configured to repeat STEP S11 through the STEP S20 as described above according to the numbers of printings.

In the first and second embodiments s described above, the printer 1, 1A, which includes a duplex printing mode, includes the side registration correcting mechanism 70, 70A, which is configured to move the first sheet conveyance part 37 conveying a reversed sheet S and the second sheet conveyance part 60 in the direction perpendicular to the sheet conveying direction, and which is configured to return to the original position. Further, the printer 1, 1A includes the side position detector 80, the side position memory 97 which includes the nonvolatile memory and is configured to store the position data of the side end of the sheet S, and the main body controller 90, 90A, and the printer 1, 1A is configured to work by the cooperation of these parts.

In the first and second embodiments, the printer 1, 1A is configured to perform the side registration correction in the duplex printing mode, and to accurately correct relative positions of images formed on both faces of a sheet S such that the position of an image formed on the first face of the sheet S is aligned/corresponds to the position of an image formed on the second face of the sheet S.

In the first and second embodiments, these configurations and these operations of the printer 1, 1A as described above, enable to accurate correction of the relative positions of the images formed on the both face of the sheet S, even when the printer 1, 1A is a printer that has a smaller distance of the sheet conveyance passage between the feeding roller and the transfer roller and is compact with regard to the width of the machine.

Additional Embodiment(s)

The appended claims are not to be limited to the embodiments described herein, but are to be construed as embodying all modifications and alternative constructions that may occur to one skilled in the art that fall within the scope set forth herein.

According to the printer 1, 1A in the first and second embodiments, the side registration correcting mechanism 70, 70A is configured to be able to shift a large sheet. By contrast, when the printer 1, 1A is configured to print on both sides of a small sheet, it is possible to construct a side registration correcting mechanism such that the side registration correcting mechanism is configured to shift only the registration roller pair 38 in the duplex printing mode.

According to the configuration described above, for detecting the rear end side of the side end of the first face of the sheet S and the front end side of the side end of the second face in the sheet conveying direction by the side position detector 80, the detection signals input by the first sensor 81 and the second sensor 82 to the main body controller 90A, are output as read signals to the side position detector 80. Note that it is possible to use a single sensor both as the first sensor 81 and the second sensor 82. Further, according to the configuration described above, the first sensor is configured to detect the rear end side (upstream side) of the side end of the first face of the sheet S in the sheet conveying direction. However, the present disclosure is not limited in this configuration. It is possible to change the first sensor such that the first sensor detects another part of the side end of the first face of the sheet S in the sheet conveying direction.

Moreover, a user can use several optional devices to connect to the printer. For example, a sheet bank which is configured to store a large amount of the sheet and to be able to feed a large amount of sheets; a finisher device which is configured to be able to bind the sheets with staple and fold, and which is substituting for the stack tray 55; and a scanner and ADF (Auto Document Feeder) which may be disposed at an upper portion of the printer can be connected to the printer. Further, it is possible to provide only one color of image forming station in the printer.

The present disclosure is generally useful for an image forming apparatus and an image forming system which includes a duplex printing mode. Embodiments of the disclosure are able to accurately correct relative positions of images formed on both faces of a sheet, even when the printer including the duplex printing mode is compact (for example, with respect to the width of the machine).

REFERENCE LIST

1, 1A PRINTER (IMAGE FORMING APPARATUS)
10 IMAGE FORMING PART/IMAGE FORMER
30 SHEET FEEDING PART/SHEET FEEDER
37 FIRST SHEET CONVEYANCE PART/FIRST SHEET CONVEYOR
38 REGISTRATION ROLLER PAIR
50 SHEET REVERSING PART/SHEET REVERSER
60 SECOND SHEET CONVEYANCE PART/SECOND SHEET CONVEYOR
70, 70A SIDE REGISTRATION CORRECTING MECHANISM (CORRECTION MECHANISM)

80 SIDE POSITION DETECTOR (SIDE END DETECTOR)
90, 90A MAIN BODY CONTROLLER (CONTROLLER)
97 SIDE POSITION MEMORY (SIDE END MEMORY)
P1 FIRST SIDE POSITION (SIDE POSITION OF FIRST FACE OF SHEET)
P2 SECOND SIDE POSITION (SIDE POSITION OF SECOND FACE OF SHEET)
S SHEET
Y SHEET CONVEYING DIRECTION
ΔX DEVIATION

What is claimed is:

1. An image forming apparatus comprising:
a sheet feeder, including a roller, to feed a sheet to a sheet conveyance passage;
an image former, including a transfer belt, to form an image on the sheet;
a first sheet conveyor, including a registration roller, at an upstream side of an image forming position in which the image former forms the image on the sheet, to convey the sheet along a sheet conveying direction;
a sheet reverser, including a guiding roller, to reverse the sheet on which the image is formed on a first face;
a second sheet conveyor, including a conveying roller, to convey the sheet, which is reversed by the sheet reverser, to the first sheet conveyor for the image former to form the image on a second face;
a first sensor to detect a rear end of the sheet in the sheet conveying direction;
a second sensor to detect a front end of the sheet in the sheet conveying direction;
a side end detector disposed near the first sheet conveyor to detect a first rear end side position of the first face when the first sensor detects the rear end of the sheet and to detect a second front end side position of the second face when the second sensor detects the front end of the sheet;
a memory to store the first rear end side position and the second front end side position detected by the side end detector;
a correction mechanism, including a movable plate, to movably support at least the registration roller of the first sheet conveyor and the second sheet conveyor in a direction perpendicular to the sheet conveying direction; and
a controller to calculate a deviation between the first read end side position and the second front end side position, and to set the deviation as a correction amount of the correction mechanism,
wherein, in a side registration correcting operation, the controller controls movement of the correction mechanism by the correction amount.

2. The image forming apparatus according claim 1, wherein the correction mechanism includes
the movable plate, which rotatably supports the registration roller,
a cam to move the movable plate in the direction perpendicular to the sheet conveying direction, and
an actuator to drive the cam,
wherein the actuator is controlled by the controller.

3. The image forming apparatus according claim 2, wherein the cam is an eccentric cam.

4. The image forming apparatus according claim 3, wherein
the actuator is a rotary actuator,
the memory stores a data table that includes a correspondence between a rotation angle of the rotary actuator and the deviation of the sheet, and
in the side registration correcting operation, the controller controls the rotary actuator to rotate by the rotation angle.

5. The image forming apparatus according claim 2, wherein the correction mechanism includes a spring attached to the movable plate at one end thereof.

6. The image forming apparatus according claim 2, wherein the movable plate includes a single plate that rotatably supports the first sheet conveyor and the second sheet conveyor.

7. The image forming apparatus according claim 2, wherein the movable plate includes a first movable plate and a second movable plate, the first movable plate rotatably supports the first sheet conveyor, and the second movable plate rotatably supports the second sheet conveyor.

8. The image forming apparatus according claim 7, wherein each of the first movable plate and the second movable plate is associated with a cam and an actuator.

9. The image forming apparatus according claim 8, wherein when a length of the sheet, in the sheet conveying direction, is shorter than a length of the sheet conveyance passage between the image forming position and a roller that is a most downstream roller of the second sheet conveyor, the controller controls the actuator associated with the first movable plate in the side registration correcting operation.

10. The image forming apparatus according claim 8, wherein when a length of the sheet, in the sheet conveying direction, is longer than a length of the sheet conveyance passage between the image forming position and a roller that is a most downstream roller of the second sheet conveyor, the controller controls the actuators associated with the first movable plate and the second movable plate in the side registration correcting operation.

11. The image forming apparatus according claim 2, wherein the side end detector is disposed on a side opposite the movable plate across the sheet conveyance passage in the direction perpendicular to the sheet conveying direction.

12. The image forming apparatus according claim 1, wherein the side end detector includes a contact image sensor.

13. The image forming apparatus according claim 1, wherein the controller performs the side registration correcting operation when the registration roller is conveying the reversed sheet.

14. An image forming system comprising:
an image forming apparatus to form an image on a sheet; and
a sheet bank to store a plurality of sheets, and to feed the plurality of sheets to the image forming apparatus, wherein the image forming apparatus includes
a sheet feeder, including a roller, to feed the sheet to a sheet conveyance passage,
an image former, including a transfer belt, to form an image on the sheet,
a first sheet conveyor, including a registration roller, at an upstream side of an image forming position in which the image former forms the image on the sheet, to convey the sheet along a sheet conveying direction,
a sheet reverser, including a guiding roller, to reverse the sheet on which the image is formed on a first face,
a second sheet conveyor, including a conveying roller, to convey the sheet, which is reversed by the sheet reverser, to the first sheet conveyor for the image former to form the image on a second face;
a first sensor to detect a rear end of the sheet in the sheet conveying direction;
a second sensor to detect a front end of the sheet in the sheet conveying direction;

a side end detector disposed near the first sheet conveyor to detect a first rear end side position of the first face when the first sensor detects the rear end of the sheet and to detect a second front end side position of the second face when the second sensor detects the front end of the sheet;

a memory to store the first rear end side position and the second front end side position detected by the side end detector;

a correction mechanism, including a movable plate, to movably support at least the registration roller of the first sheet conveyor and the second sheet conveyor in a direction perpendicular to the sheet conveying direction; and a controller to calculate a deviation between the first read end side position and the second front end side position, and to set the deviation as a correction amount of the correction mechanism, wherein, in a side registration correcting operation, the controller controls movement of the correction mechanism by the correction amount.

15. An image forming system comprising:

an image forming apparatus to form an image on a sheet; and a finisher device to bind the sheet, which is conveyed from the image forming apparatus, with staple and fold, wherein the image forming apparatus includes a sheet feeder, including a roller, to feed the sheet to a sheet conveyance passage, an image former, including a transfer belt, to form an image on the sheet, a first sheet conveyor, including a registration roller, at an upstream side of an image forming position in which the image former forms the image on the sheet, to convey the sheet along a sheet conveying direction, a sheet reverser, including a guiding roller, to reverse the sheet on which the image is formed on a first face, a second sheet conveyor, including a conveying roller, to convey the sheet, which is reversed by the sheet reverser, to the first sheet conveyor, a second sheet conveyor, including a conveying roller, to convey the sheet, which is reversed by the sheet reverser, to the first sheet conveyor for the image former to form the image on a second face;

a first sensor to detect a rear end of the sheet in the sheet conveying direction;

a second sensor to detect a front end of the sheet in the sheet conveying direction;

a side end detector disposed near the first sheet conveyor to detect a first rear end side position of the first face when the first sensor detects the rear end of the sheet and to detect a second front end side position of the second face when the second sensor detects the front end of the sheet;

a memory to store the first rear end side position and the second front end side position detected by the side end detector;

a correction mechanism, including a movable plate, to movably support at least the registration roller of the first sheet conveyor and the second sheet conveyor in a direction perpendicular to the sheet conveying direction; and a controller to calculate a deviation between the first read end side position and the second front end side position, and to set the deviation as a correction amount of the correction mechanism, wherein, in a side registration correcting operation, the controller controls movement of the correction mechanism by the correction amount.

* * * * *